US011761702B2

(12) United States Patent
Choi et al.

(10) Patent No.: US 11,761,702 B2
(45) Date of Patent: Sep. 19, 2023

(54) REFRIGERATOR AND CONTROL METHOD THEREFOR

(71) Applicant: LG ELECTRONICS INC., Seoul (KR)

(72) Inventors: Kwang Hyun Choi, Seoul (KR); Chang Won Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 901 days.

(21) Appl. No.: 16/585,816

(22) Filed: Sep. 27, 2019

(65) Prior Publication Data

US 2021/0018261 A1 Jan. 21, 2021

(30) Foreign Application Priority Data

Jul. 15, 2019 (KR) ..... 10-2019-0085201

(51) Int. Cl.

| | |
|---|---|
| ***F25D 29/00*** | (2006.01) |
| ***F25D 11/02*** | (2006.01) |
| ***F25D 25/00*** | (2006.01) |
| ***F25D 25/02*** | (2006.01) |
| ***E05F 15/73*** | (2015.01) |

(52) U.S. Cl.

CPC ..... *F25D 29/003* (2013.01); *E05F 15/73* (2015.01); *F25D 11/02* (2013.01); *F25D 25/005* (2013.01); *F25D 25/025* (2013.01); *F25D 2325/021* (2013.01); *F25D 2700/02* (2013.01)

(58) Field of Classification Search

CPC ..... F25D 29/003; F25D 11/02; F25D 25/005; F25D 2325/021; F25D 2700/02; F25D 23/02; F25D 25/028; F25D 29/00; E05B 65/463; E05B 65/0042; A47B 88/453

See application file for complete search history.

(56) References Cited

U.S. PATENT DOCUMENTS

| | | | |
|---|---|---|---|
| 658,999 | A | 10/1900 | Scannel |
| 1,067,404 | A | 7/1913 | Callaghan |
| 2,072,244 | A | 3/1937 | Coursen |
| 2,679,658 | A | 6/1954 | Mccormick |

(Continued)

FOREIGN PATENT DOCUMENTS

| | | |
|---|---|---|
| CN | 100417900 | 9/2008 |
| CN | 101981397 | 2/2011 |

(Continued)

OTHER PUBLICATIONS

United States Notice of Allowance dated Feb. 23, 2022 issued in co-pending related U.S. Appl. No. 16/582,518.

(Continued)

*Primary Examiner* — Kun Kai Ma

(74) *Attorney, Agent, or Firm* — KED & ASSOCIATES, LLP

(57) ABSTRACT

A refrigerator and a control method therefor are provided. When a user input is received, an upper drawer of the refrigerator is opened by operating an opening/closing motor of the upper drawer, and it is determined whether opening of a lower drawer is detected by an open/close detecting part of the lower drawer when the upper drawer is opened. The lower drawer is closed by operating the opening/closing motor of the lower drawer when the opening of the lower drawer is detected.

11 Claims, 29 Drawing Sheets

(56) References Cited

U.S. PATENT DOCUMENTS

| | | | | |
|---|---|---|---|---|
| 2,731,318 | A | 1/1956 | Hoff | |
| 4,545,628 | A | 10/1985 | Richey | |
| 5,253,488 | A | 10/1993 | Kim et al. | |
| 6,044,606 | A | 4/2000 | Hamar | |
| 6,109,774 | A | 8/2000 | Holmes et al. | |
| 6,371,584 | B1 | 4/2002 | Alreck | |
| 6,722,749 | B1 | 4/2004 | Pagac | |
| 7,600,829 | B2 | 10/2009 | Oh et al. | |
| 7,600,830 | B2 | 10/2009 | Oh et al. | |
| 7,600,833 | B2 | 10/2009 | Oh et al. | |
| 7,690,586 | B2 | 4/2010 | Kang | |
| 8,282,177 | B1 | 10/2012 | Rotter | |
| 8,360,539 | B2 | 1/2013 | Brown et al. | |
| 8,376,481 | B2 | 2/2013 | Lee | |
| 8,497,644 | B2 * | 7/2013 | Eom | A47B 88/457 318/264 |
| 8,668,289 | B2 | 3/2014 | Lee et al. | |
| 8,794,722 | B2 | 8/2014 | Nuss et al. | |
| 8,844,110 | B2 | 9/2014 | Rotter | |
| 8,864,249 | B2 | 10/2014 | Nam et al. | |
| 9,107,494 | B2 | 8/2015 | Scheuring et al. | |
| 9,377,238 | B2 | 6/2016 | Hall et al. | |
| 9,523,533 | B2 | 12/2016 | Nam et al. | |
| 9,982,937 | B2 | 5/2018 | Tierney et al. | |
| 10,234,195 | B2 | 3/2019 | Yasaka et al. | |
| 10,465,970 | B1 | 11/2019 | Kang et al. | |
| 10,598,428 | B2 | 3/2020 | Kim | |
| 10,690,401 | B2 | 6/2020 | Yang et al. | |
| 10,712,083 | B1 | 7/2020 | Choi | |
| 10,767,920 | B1 | 9/2020 | Choi | |
| 10,786,080 | B1 | 9/2020 | Stravitz et al. | |
| 10,876,788 | B2 | 12/2020 | Choi | |
| 10,932,568 | B2 | 3/2021 | Subrahmanya et al. | |
| 10,939,758 | B2 | 3/2021 | Kim | |
| 11,033,104 | B2 | 6/2021 | Kim | |
| 11,047,619 | B2 | 6/2021 | Choi | |
| 11,131,500 | B2 | 9/2021 | Kim | |
| 2003/0201700 | A1 | 10/2003 | Cho | |
| 2004/0031705 | A1 | 2/2004 | Detemple, II et al. | |
| 2004/0046488 | A1 | 3/2004 | Hogan | |
| 2004/0056573 | A1 | 3/2004 | Chae | |
| 2006/0042306 | A1 | 3/2006 | Choi et al. | |
| 2006/0087207 | A1 | 4/2006 | Oh et al. | |
| 2006/0087208 | A1 | 4/2006 | Oh et al. | |
| 2006/0207283 | A1 | 9/2006 | Kim et al. | |
| 2006/0248916 | A1 | 11/2006 | Kim et al. | |
| 2006/0250062 | A1 | 11/2006 | Janda et al. | |
| 2007/0262686 | A1 | 11/2007 | Ji | |
| 2008/0018215 | A1 | 1/2008 | Carden et al. | |
| 2009/0045713 | A1 | 2/2009 | Kunkle et al. | |
| 2009/0160298 | A1 | 6/2009 | Chen et al. | |
| 2009/0167131 | A1 | 7/2009 | Oh et al. | |
| 2009/0277210 | A1 | 11/2009 | Eveland et al. | |
| 2010/0192621 | A1 | 8/2010 | Kim | |
| 2010/0236278 | A1 | 9/2010 | Eom et al. | |
| 2010/0236279 | A1 | 9/2010 | Eom et al. | |
| 2010/0239795 | A1 | 9/2010 | Gat | |
| 2010/0283365 | A1 | 11/2010 | Chen | |
| 2011/0005264 | A1 | 1/2011 | Lee et al. | |
| 2011/0006656 | A1 | 1/2011 | Nam et al. | |
| 2011/0050065 | A1 | 3/2011 | Lee et al. | |
| 2011/0050066 | A1 | 3/2011 | Lee et al. | |
| 2011/0146333 | A1 | 6/2011 | Koo et al. | |
| 2011/0162402 | A1 | 7/2011 | Park | |
| 2011/0181163 | A1 | 7/2011 | Han et al. | |
| 2011/0210655 | A1 | 9/2011 | Brown et al. | |
| 2012/0091872 | A1 | 4/2012 | Matthes et al. | |
| 2012/0125035 | A1 | 5/2012 | Chellappan et al. | |
| 2012/0306338 | A1 | 12/2012 | Nagahata et al. | |
| 2013/0055543 | A1 | 3/2013 | Rotter | |
| 2013/0129267 | A1 | 5/2013 | Chen | |
| 2013/0145972 | A1 | 6/2013 | Knox et al. | |
| 2013/0264928 | A1 | 10/2013 | Hong et al. | |
| 2013/0270986 | A1 | 10/2013 | Min et al. | |
| 2013/0270987 | A1 | 10/2013 | Kelly | |
| 2013/0270989 | A1 | 10/2013 | Park et al. | |
| 2014/0191646 | A1 | 7/2014 | Nuss et al. | |
| 2014/0265783 | A1 | 9/2014 | Hauer et al. | |
| 2014/0265797 | A1 | 9/2014 | Scheuring et al. | |
| 2014/0265806 | A1 | 9/2014 | Hall et al. | |
| 2014/0319990 | A1 | 10/2014 | Gephart et al. | |
| 2015/0059398 | A1 | 3/2015 | Yoo et al. | |
| 2015/0059399 | A1 | 3/2015 | Hwang et al. | |
| 2015/0069899 | A1 | 3/2015 | Han et al. | |
| 2015/0184918 | A1 | 7/2015 | Klingshirn et al. | |
| 2016/0146533 | A1 | 5/2016 | Jung | |
| 2016/0153704 | A1 | 6/2016 | Burke et al. | |
| 2016/0178274 | A1 | 6/2016 | Shin | |
| 2016/0265816 | A1 | 9/2016 | Gillette et al. | |
| 2016/0305705 | A1 | 10/2016 | Dubina et al. | |
| 2016/0320118 | A1 | 11/2016 | Millett | |
| 2016/0370063 | A1 | 12/2016 | Yang | |
| 2017/0024946 | A1 | 1/2017 | Hashemi et al. | |
| 2017/0051967 | A1 | 2/2017 | Tierney et al. | |
| 2017/0122651 | A1 | 5/2017 | Cizik et al. | |
| 2017/0227279 | A1 | 8/2017 | Yang et al. | |
| 2017/0336129 | A1 | 11/2017 | Cunningham | |
| 2017/0362864 | A1 * | 12/2017 | Fazi | E05B 41/00 |
| 2018/0128540 | A1 | 5/2018 | Yasaka et al. | |
| 2018/0283771 | A1 | 10/2018 | Shin et al. | |
| 2018/0291669 | A1 | 10/2018 | Kim et al. | |
| 2018/0356148 | A1 | 12/2018 | Fei et al. | |
| 2019/0219324 | A1 | 7/2019 | Kang | |
| 2019/0242640 | A1 | 8/2019 | Minoru et al. | |
| 2019/0292831 | A1 | 9/2019 | Choi | |
| 2019/0293341 | A1 | 9/2019 | Yeom | |
| 2019/0323763 | A1 | 10/2019 | Kang | |
| 2019/0346199 | A1 | 11/2019 | Choi | |
| 2019/0390895 | A1 | 12/2019 | Choi | |
| 2020/0011593 | A1 | 1/2020 | Ji | |
| 2020/0069056 | A1 | 3/2020 | Kim | |
| 2020/0072540 | A1 | 3/2020 | Kim | |
| 2020/0072542 | A1 | 3/2020 | Kim | |
| 2021/0003337 | A1 | 1/2021 | Voltarelli et al. | |
| 2021/0259416 | A1 | 8/2021 | Kim | |

FOREIGN PATENT DOCUMENTS

| | | |
|---|---|---|
| CN | 102226626 | 10/2011 |
| CN | 202254607 | 5/2012 |
| CN | 202970226 | 6/2013 |
| CN | 204902419 | 12/2015 |
| CN | 107388718 | 11/2017 |
| CN | 108645104 | 10/2018 |
| CN | 109028726 | 12/2018 |
| CN | 208640001 | 3/2019 |
| CN | 109690213 | 4/2019 |
| CN | 208736030 | 4/2019 |
| CN | 109838961 | 6/2019 |
| CN | 109990557 | 7/2019 |
| CN | 110873500 | 3/2020 |
| DE | 29620152 | 4/1997 |
| DE | 10 2005 016 418 | 11/2005 |
| EP | 1 724 540 | 11/2006 |
| EP | 2 299 215 | 3/2011 |
| EP | 2 752 632 | 7/2014 |
| EP | 3 023 721 | 5/2016 |
| EP | 3 505 854 | 7/2019 |
| EP | 3 546 862 | 10/2019 |
| EP | 3 617 630 | 3/2020 |
| GB | 2108564 | 5/1983 |
| JP | H04-138337 | 12/1992 |
| JP | H07-275049 | 10/1995 |
| JP | H08-303944 | 11/1996 |
| JP | 2001-280824 | 10/2001 |
| JP | 2002-264943 | 9/2002 |
| KR | 10-2006-0025806 | 3/2006 |
| KR | 10-2006-0027592 | 3/2006 |
| KR | 10-2006-0053420 | 5/2006 |
| KR | 10-2007-0075671 | 7/2007 |
| KR | 10-2008-0101335 | 11/2008 |
| KR | 10-2009-0027111 | 3/2009 |
| KR | 10-2009-0027112 | 3/2009 |
| KR | 10-2009-0102576 | 9/2009 |

(56) References Cited

FOREIGN PATENT DOCUMENTS

| | | | |
|---|---|---|---|
| KR | 10-2009-0102577 | | 9/2009 |
| KR | 10-0921380 | | 10/2009 |
| KR | 10-2009-0114265 | | 11/2009 |
| KR | 10-2010-0012544 | | 2/2010 |
| KR | 10-0946784 | | 3/2010 |
| KR | 10-2010-0078916 | | 7/2010 |
| KR | 10-2011-0015331 | | 2/2011 |
| KR | 20110014331 | A * | 2/2011 |
| KR | 20-0460442 | | 6/2012 |
| KR | 10-2013-0071919 | | 7/2013 |
| KR | 10-2014-0037474 | | 3/2014 |
| KR | 10-2018-0138083 | | 12/2018 |
| KR | 10-2018-0138085 | | 12/2018 |
| KR | 10-2019-0081331 | | 7/2019 |
| WO | 92/14522 | | 9/1992 |
| WO | WO 03/016661 | | 2/2003 |
| WO | WO 2018/051963 | | 3/2018 |
| WO | WO 2019/242234 | | 12/2019 |

OTHER PUBLICATIONS

United States Notice of Allowance dated Feb. 23, 2022 issued in co-pending related U.S. Appl. No. 16/585,284.
Chinese Office Action dated Aug. 24, 2021 issued in CN Application No. 201910911796.9.
Chinese Office Action dated Sep. 8, 2021 issued in CN Application No. 201910857458.1.
Chinese Office Action dated Sep. 14, 2021 issued in CN Application No. 201910905166.0.
United States Office Action dated Oct. 15, 2021 issued in co-pending related U.S. Appl. No. 16/582,755.
European Search Report dated Mar. 12, 2020 issued in EP Application No. 19199586.9.
European Search Report dated Mar. 17, 2020 issued in EP Application No. 19199553.9.
European Search Report dated Mar. 20, 2020 issued in EP Application No. 19199569.5.
European Search Report dated Mar. 30, 2020 issued in EP Application No. 19199556.2.
European Search Report dated Apr. 3, 2020 issued in EP Application No. 19199625.5.
European Search Report dated Apr. 6, 2020 issued in EP Application No. 19199629.7.
European Search Report dated Apr. 6, 2020 issued in EP Application No. 19199587.7.
European Search Report dated Apr. 7, 2020 issued in EP Application No. 19199607.3.
GE (Refrigerator Freezer Door Pops Open, https:/ /products.geappliances.com/appliance/gea-support-search-content?contentId=16979) (Year: 2015).
United States Office Action dated Apr. 11, 2022 issued in co-pending related U.S. Appl. No. 16/585,301.
European Search Report dated Aug. 14, 2020 issued in EP Application No. 19199647.9.
U.S. Appl. No. 17/830,750, filed Jun. 2, 2022.
Chinese Office Action dated Sep. 3, 2021 issued in CN Application No. 201910905106.9.
European Office Action dated Sep. 1, 2021 issued in EP Application No. 19199607.3.
Chinese Office Action dated May 16, 2022 issued in CN Application No. 201910905106.9.
United States Office Action dated Jan. 31, 2022 issued in co-pending related U.S. Appl. No. 16/582,756.
United States Office Action dated Feb. 2, 2022 issued in co-pending related U.S. Appl. No. 16/582,605.
European Search Report dated Apr. 1, 2020 issued in EP Application No. 19199637.0.
European Office Action dated Sep. 30, 2020 issued in EP Application No. 19199556.2.
European Communication dated Feb. 8, 2021 issued in Application No. 19199627.1.
United States Office Action dated Nov. 19, 2020 issued in U.S. Appl. No. 16/582,831.
Chinese Office Action dated Aug. 20, 2021 issued in CN Application No. 201910857469.X.
Chinese Office Action dated Aug. 25, 2021 issued in CN Application No. 201910911807.3.
Chinese Office Action dated Sep. 2, 2021 issued in CN Application No. 201910871084.9.
Chinese Office Action dated Sep. 17, 2021 issued in CN Application No. 201910905094.X.
United States Office Action dated Oct. 6, 2021 issued in co-pending related U.S. Appl. No. 16/583,726.
United States Office Action dated Oct. 6, 2021 issued in co-pending related U.S. Appl. No. 16/582,647.
United States Office Action dated Oct. 6, 2021 issued in co-pending related U.S. Appl. No. 16/582,668.
U.S. Appl. No. 16/583,726, filed Sep. 26, 2019.
U.S. Appl. No. 16/582,647, filed Sep. 25, 2019.
U.S. Appl. No. 16/582,518, filed Sep. 25, 2019.
U.S. Appl. No. 16/582,605, filed Sep. 25, 2019.
U.S. Appl. No. 16/582,712, filed Sep. 25, 2019.
U.S. Appl. No. 16/582,756, filed Sep. 25, 2019.
U.S. Appl. No. 16/582,810, filed Sep. 25, 2019.
U.S. Appl. No. 16/582,668, filed Sep. 25, 2019.
U.S. Appl. No. 16/582,755, filed Sep. 25, 2019.
U.S. Appl. No. 16/582,831, filed Sep. 25, 2019.
U.S. Appl. No. 16/585,284, filed Sep. 27, 2019.
U.S. Appl. No. 16/585,301, filed Sep. 27, 2019.
U.S. Appl. No. 16/585,816, filed Sep. 27, 2019.
United States Office Action dated Mar. 4, 2020 issued in U.S. Appl. No. 16/582,712.
United States Office Action dated Mar. 9, 2020 issued in U.S. Appl. No. 16/582,810.
European Search Report dated Mar. 23, 2020 issued in EP Application No. 19199602.4.
United States Office Action dated Jan. 5, 2023 issued in co-pending related U.S. Appl. No. 16/585,301.

* cited by examiner

REFRIGERATOR AND CONTROL METHOD THEREFOR

CROSS-REFERENCE TO RELATED APPLICATION(S)

The present application claims priority to Korean Patent Application No. 10-2019-0085201, filed in Korea on Jul. 15, 2019, the entire contents of which are incorporated herein by reference.

BACKGROUND

1. Field

The present disclosure relates to a refrigerator and a control method therefor.

2. Background

In general, a refrigerator is an appliance that provides a storage space that may be maintained at relatively low temperatures. To this end, a refrigerator may cool the storage space using cold air produced by heat exchange with a refrigerant circulating in a refrigeration cycle.

A refrigerator may include various mechanisms to open and close the storage space of the refrigerator. Refrigerators may be classified, for example, according to an arrangement of storage spaces and a structure of mechanisms for opening and closing the storage spaces. For example, refrigerators may include multiple storage spaces that may be opened and closed by swinging doors and/or sliding drawers. For example, a refrigerator may include a drawer positioned in a lower area of the refrigerator, such that a user would bend and down to access the drawer.

To improve access to the drawer, a refrigerator may include a mechanism to raise a drawer or the contents thereof. For example, Korean Patent Application Publication No. 10-2008-0101335 describes a refrigerator having a mechanism on a rear surface of a door to raise and lower a storage container. In another example, Korea Patent Application Publication No. 10-2006-0053420 describes a structure in which a basket may be raised by a support member provided in a door. In these types of refrigerator in which a lower drawer may be raised, damage may occur due to an impact between the rising lower drawer and an upper drawer that, when opened, may be positioned above the lower rising drawer. In addition, when multiple drawers may be opened concurrently, a center of gravity for the refrigerator may be moved forward such that the refrigerator body may tip over and fall forward, which may cause serious safety concerns for the user.

The above references may be incorporated by reference herein where appropriate for appropriate teachings of additional or alternative details, features and/or technical background.

BRIEF DESCRIPTION OF THE DRAWINGS

Embodiments will be described for example with reference to the following drawings in which like reference numerals refer to like elements, and wherein.

DETAILED DESCRIPTION

Figure 1:
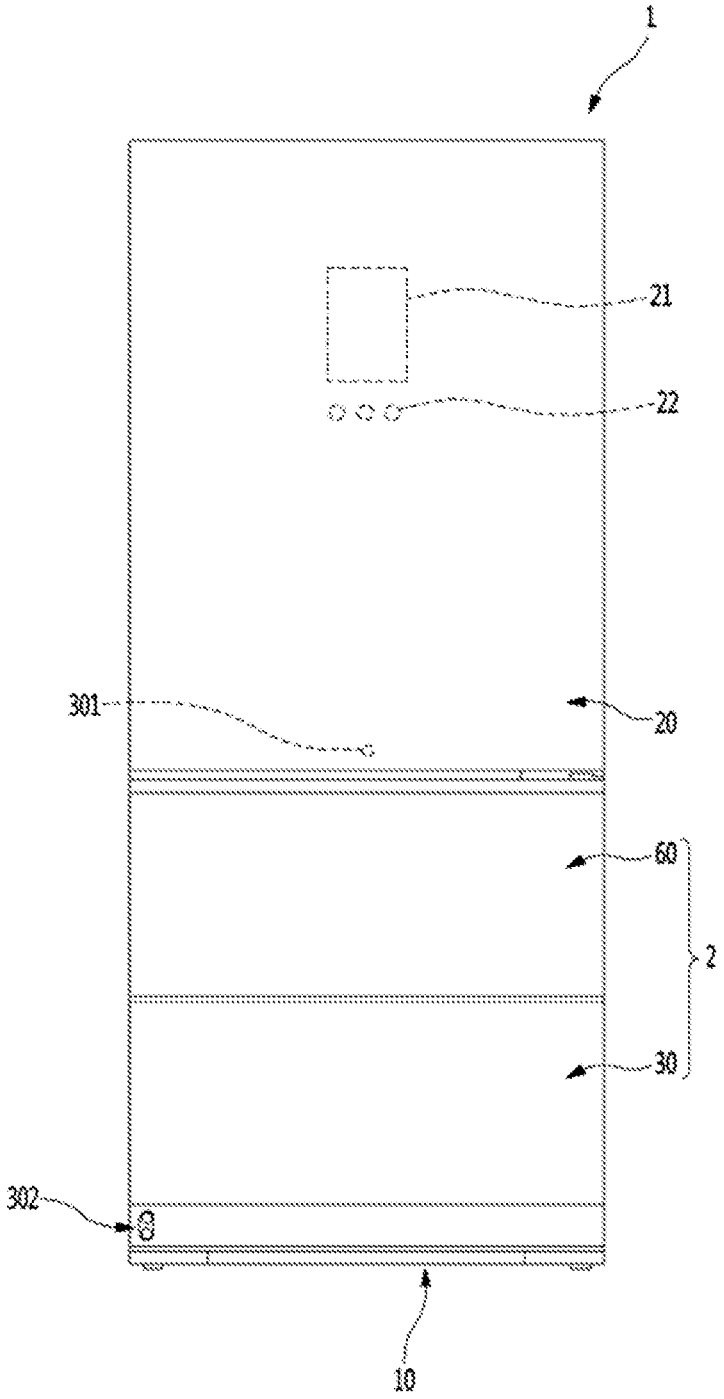
FIG. 1 may be a front view illustrating a refrigerator according to an embodiment of the present disclosure.
Figure 2:
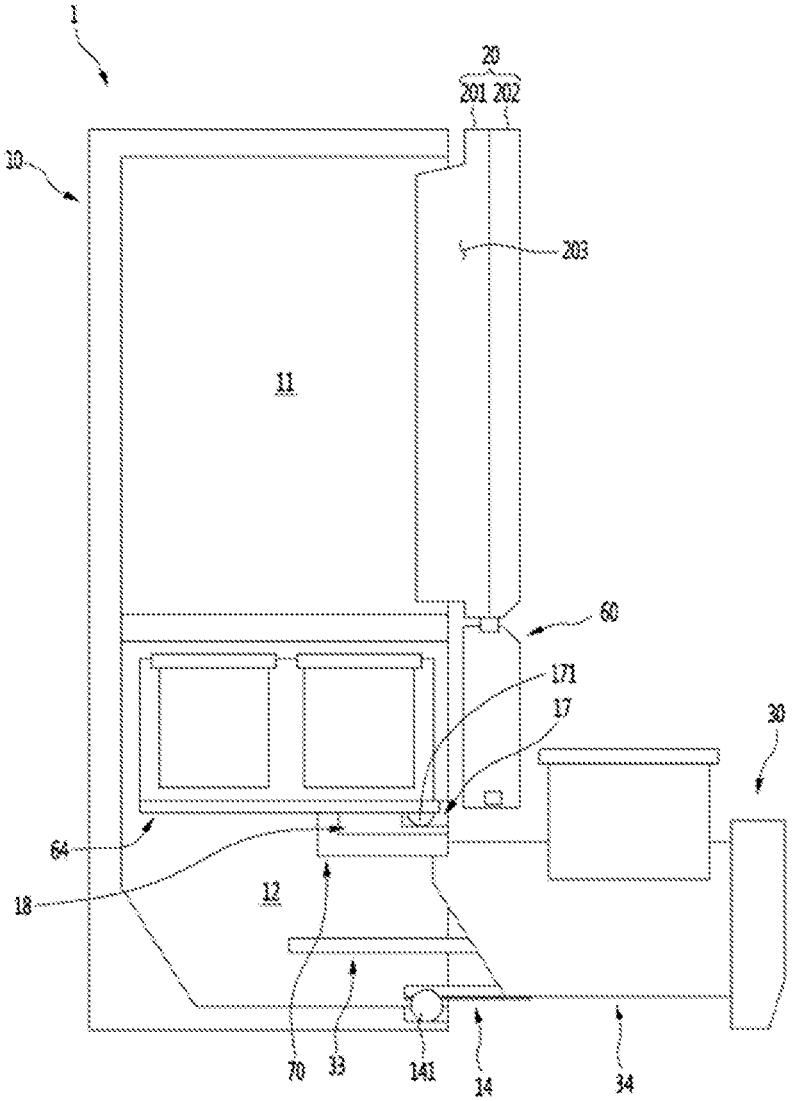
FIG. 2 may be a schematic cross-sectional view illustrating a longitudinal section of the refrigerator.

Hereinafter, embodiments of the present disclosure will be described for example with reference to the accompanying drawings. FIG. 1 shows a front view illustrating a refrigerator according to an embodiment of the present disclosure, and FIG. 2 shows a schematic cross-sectional view illustrating a longitudinal section of the refrigerator.

As shown in the drawing, the refrigerator 1 may include a cabinet 10 that provides a storage space and a door that shields an opened front surface of the cabinet 10, which forms an outer shape of the refrigerator 1. The storage space inside the cabinet 10 may be partitioned into a plurality of spaces. For example, the cabinet 10 may be partitioned into a refrigerator compartment 11 of an upper space and a freezer compartment 10 of a lower space. In other examples, the upper space and the lower space may be partitioned into independent spaces maintained at various different temperatures from each other, and not merely correspond to the refrigerator compartment 11 or the freezer compartment 12, and may be referred to as an upper storage space 11 and a lower storage space 12, or a first storage space and a second storage space.

The door may include a swinging door 20 that opens and closes the upper storage space 11 by rotation of the swinging door 20, and a drawer 2 that opens and closes the lower storage space 12 by pushing and pulling out the drawer 30. Although the present disclosure provides examples related to a refrigerator in which the swinging door 20 and the drawer 2 may be positioned together, the present disclosure may be not limited thereto, and may be applicable to all types of refrigerators having one or more drawer-type doors.

In some examples, the swinging door 20 may include a main door 201 and a sub door 202. The main door 201 may be rotatably mounted on the cabinet 10, and have a door reception space 203 for a separate storage provided at an opened center area. The door reception space 203 may include multiple baskets. In addition, the sub door 202 may shield the opened front surface of the main door 201. Accordingly, the user may open and close the upper storage space 11 by rotating the main door 201, and may open and close the door reception space 203 by rotating the sub door 202.

The display 21 may be provided at a side of the front surface of the swinging door 20, and the display 21 may be structured with a liquid crystal display structure or an 88 segment structure. In addition, when an outer shape of the door may be formed of a metal material, the display 21 may be formed so that a plurality of minute holes may be perforated to allow light transmitted therethrough to display information.

In addition, the swinging door 20 may include, at a side, a manipulation unit (or user input device) 22 capable of receiving a user command, such as a request for the automatic rotation or opening of the swinging door 20 or the drawer 2. The manipulation unit 22 may be provided integrally with the display 21 or may be formed in a touch sensor or as a button. The manipulation unit 22 may input and manipulate the overall operation of the refrigerator 1, and may manipulate the opening/closing of the drawer 2 or the lifting of a lifting member 35 in the drawer 2.

The drawer 2 may be provided at the lower storage space 12, and may have a structure like a drawer that may be opened and closed in a horizontal direction (e.g., front to rear). The drawer 2 may have a storage space opened upwards in the opened state. In addition, a part of the drawer 2 may be configured to be raised when opened state so that a container received inside the drawer 2 may be moved upwards to allow a user to easily access the container.

In some examples, the lower storage space 12 may be partitioned by a partition member 18. The partition member 18 may extend from horizontally (e.g., from the left end to the right end of the lower storage space), and may have a predetermined width and thickness. In addition, the partition member 18 may partition all or a part of the lower storage space, and may be provided only at a part of the first half so that the partition member 18 may be in contact with at least the drawer 2 to cause the drawer 2 to be hermetically sealed.

The lower storage space may include an upper drawer 60 and a lower drawer 30 with respect to the partition member 18. Both the upper drawer 60 and the lower drawer 30 may have a structure that may be opened forwards, and the partition member 18 may be provided between the upper drawer 60 and the lower drawer 30. The upper drawer 60 and the lower drawer 30 may be configured to be in contact with each other in a state where the upper drawer 60 and the lower drawer 30 may be closed.

The upper drawer 60 and the lower drawer 30 may be configured to be automatically raised by a user's manipulation. For this purpose, a manipulation unit (or input device) 301 may be provided at the lower drawer 30. The manipulation unit 301 may be configured as a touch sensor or a button. In other examples, the manipulation unit 301 may be configured as a sensor that detects a user's proximity or movement, or may be configured so that a user input may be determined based on the user's motion or voice. For example, manipulation unit 301 may include a camera to capture an image of a user and/or a microphone to capture audio from the user.

In addition, as shown in the drawings, another manipulation device (or user input device) 302 may be provided at a lower end of the lower drawer 30. For example, the manipulation device 302 may project that an image on the floor to act like a "virtual" switch and may detect an input as the user approaches the corresponding area.

In some examples, an opening/closing motor 14 may be provided at the bottom of the lower storage space 12, and a rack 34 coupled with a pinion 141 rotated by the drawer motor 14 may be provided at the bottom of the lower drawer 30. Therefore, the lower drawer 30 may be automatically opened and closed according to the manipulation of the manipulation unit 301.

In addition, the food or container provided in the lower drawer 30 may be raised when the lower drawer 30 opens according to the manipulation of the manipulation unit 301. For example, the lower drawer 30 may be automatically opened and closed and/or automatically based on an input received by at least one of multiple devices 22, 301, and 302 for manipulations. In other examples, only one of the multiple devices 22, 301, and 302 for manipulations may be provided, as desired.

The lower drawer 30 may be configured so that the opening/closing and the lifting may be automatically operated in succession in association with each other, and may be configured so that the opening/closing and the lifting may be manipulated respectively by the user's manipulation. In addition, the upper drawer 60 may also be automatically opened and closed, or raised up. For example, the upper opening/closing motor 17 may be provided in the partition member 18, and an upper rack 64 coupled to the upper pinion 171 may be provided at a bottom surface of the upper drawer 60.

Hereinafter, the lower drawer 30 will be described in more detail. The upper drawer 60 may have similar structure as the lower drawer 30 and/or a structure capable of being raised, and a detailed description therefor will be omitted to avoid duplication of description.

Figure 3:
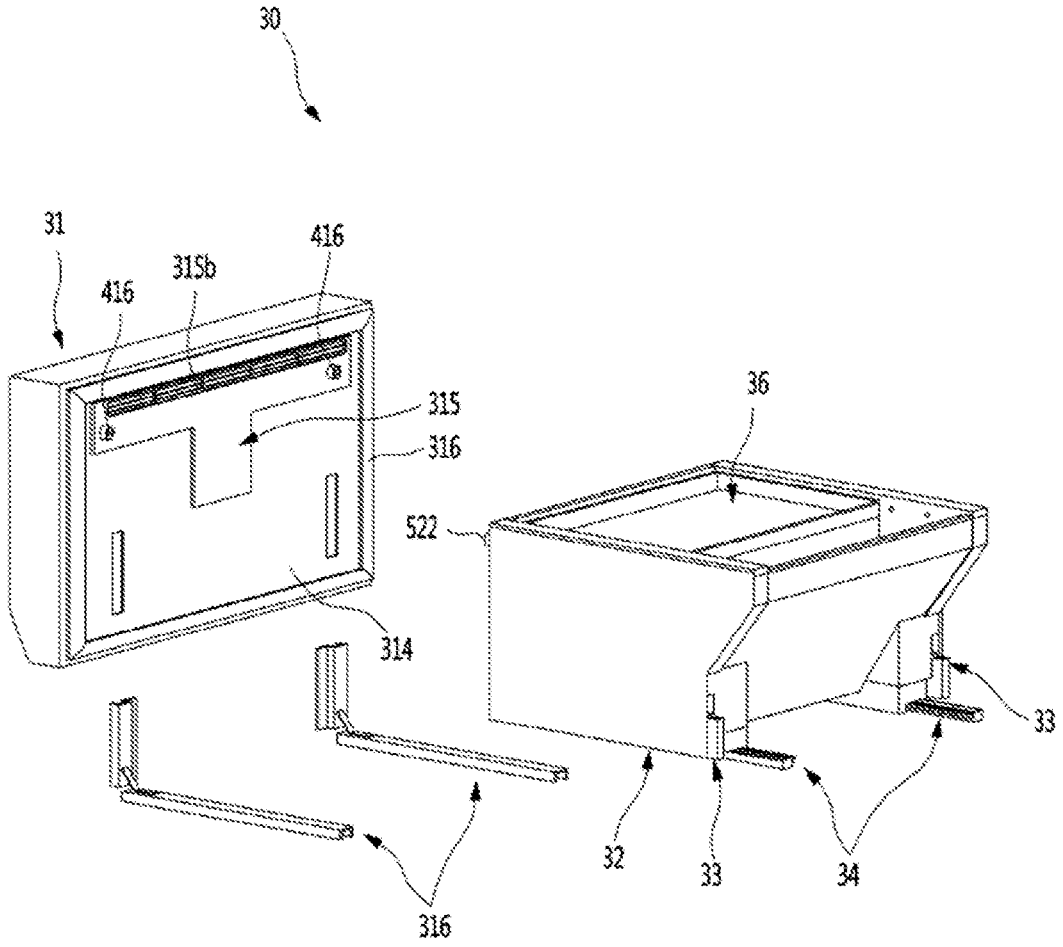
FIG. 3 may be an exploded perspective view showing a drawer.
Figure 4:
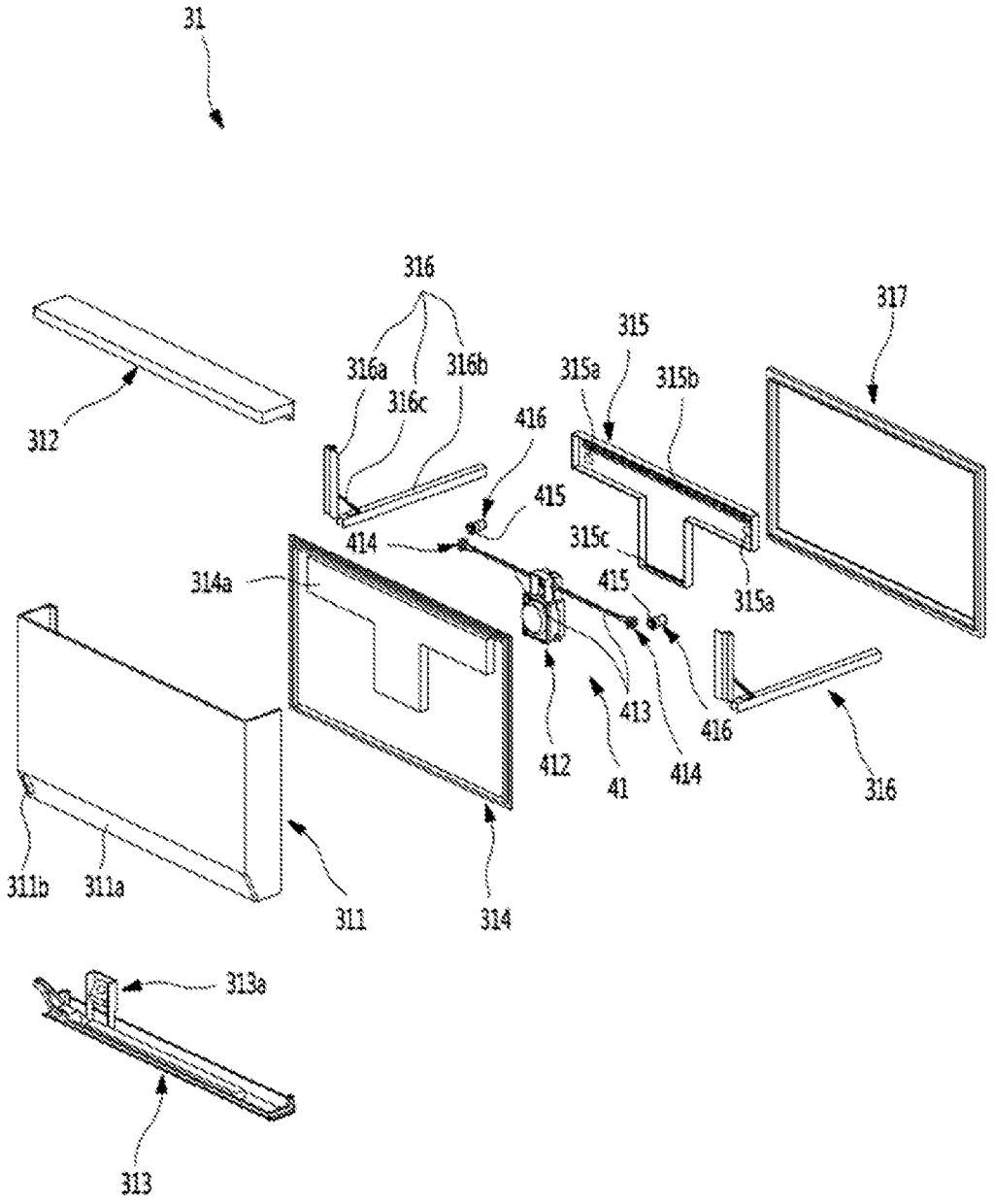
FIG. 4 may be an exploded perspective view of a front panel of the drawer.

FIG. 3 shows an exploded perspective view showing a drawer 30. As shown in the figure, the lower drawer 30 may be a front panel 31 that opens and closes the storage space, and a drawer portion (or bin) 32 which may be coupled to a rear surface of the front panel 31 that may be opened and closed together with the front panel 31.

The front panel 31 may be exposed to the outside of the cabinet 10 to form a portion of an outer shape of the refrigerator 1, and the drawer portion 32 may be positioned inside the cabinet 10 to form a storage space. In addition, the front panel 31 and the drawer portion 32 may be configured to be coupled to each other and, thus, opened/closed together in the front and rear direction.

The drawer portion 32 may be positioned on the rear surface of the front panel 31 to form a space in which food or a container may be received for storage. The inside of the drawer portion 32 may form a reception space opened upward. When the lower drawer 30 closes, a machine room 3 in which electrical components, such as a compressor and a condenser of a refrigeration cycle, may be provided rearwards of the lower drawer 30. Accordingly, the rear half of the drawer portion 32 may have a shape in which the upper end protrudes more than the lower end, and a rear surface of the drawer portion 32 may form an inclined surface 321.

In addition, the drawer portion 32 may include, on both side surfaces, a rail 33 capable of guiding the opening/closing of the lower drawer 30. The lower drawer 30 may be mounted on the cabinet 10 in an opening/closing manner by the rail 33. The rail 33 may be configured to be shielded by the outer side plate 391 so as not to be exposed to the outside. The rail 33 may be configured as a rail structure capable of extending in multiple stages.

In addition, the rail 33 may be provided at lower ends of both sides of the drawer portion 32, and thus, the rail 33 may be positioned on the bottom surface of the drawer portion 32. Accordingly, the rail 33 may be provided on the bottom surface of the drawer portion 32, which may be referred to as an under rail.

The rack 34 may be provided on the bottom surface of the drawer portion 32. The rack 34 may be positioned at both sides, and may be associated with operation of the opening/closing motor 14 mounted on the cabinet 10 to enable automatic opening/closing of the lower drawer 30. For example, when entering the manipulation using the manipulation units 22 and 301, the opening/closing motor 14 may be operated to cause the opening/closing. Herein, the drawer 2 may be stably opened/closed by the rail 33. In other examples, the drawer portion 32 may not include a rack 34, and the lower drawer 30 may be configured to be directly opened and closed by allowing a user to push or pull the front panel 31 with holding one side thereof in her/his hand.

In some examples, the inside of the drawer portion 32 may be divided into a front space S1 and a rear space S2. The front space S1 may include a lifting member (or lifting mechanism) 35 that rise up and down, and a container 36 seated on the lifting member 35 that is raised together with the lifting member 35. The container 36 may be illustrated in the form of a basket with the top portion opened, but may have a closed box structure such as a Kimchi container, and have a structure in which a plurality of containers 36 may be stacked or arranged side by side on the lifting member 35.

In addition, the drawer portion 32 may not be entirely opened out of the storage space due to the limitation of the opening distance of the lower drawer 30 when the lower drawer 30 may be opened. For example, the front space S1 may be drawn out of the storage space while all or part of the rear space S2 remains inside the storage space in the cabinet when the drawer 30 is fully extended. Such a structure may be because the opening distance of the lower drawer 30 may be limited by the rack 34 or the rail 33. Additionally, the longer the opening distance, the greater the moment applied to the lower drawer 30 in the opened state, such that it may be difficult to maintain a stable state and a deformation or breakage of the rail 33 or the rack 34 may occur.

The lifting member 35 may be received in the front space S1, and the lifting member 35 may be configured such that the food or container 36 seated on the lifting member 35 may be raised together when the lifting member 35 is raised in the vertical direction. In addition, the components 50 for lifting the lifting member 35 may be positioned at both left and right sides of the drawer portion 32 and may allow the lifting member 34 to be raised at the centers of both sides thereof.

A separate drawer cover 37 may be provided in the rear space S2. The drawer cover 37 may divide the interior of the drawer portion 32 into the front space S1 and the rear space S2. When the drawer cover 37 is mounted, the front and top surfaces of the rear space S2 may be shielded and not used. However, when the drawer cover 37 is removed, the rear space S2 may be accessible so that food may be stored in the rear space S2. In order to utilize the rear space S2, a separate pocket or a container corresponding to a shape of the rear space may be positioned in the rear space S2.

The front panel 31 and the drawer portion 32 constituting the lower drawer 30 may have a structure that may be separated from and combined with each other. The structure in which the front panel 31 and the drawer portion 32 may be separated from each other may improve assembly workability and serviceability. For example, the rear surface of the front panel 31 and the front surface of the drawer portion 32 may be coupled to each other, and the front panel 31 and the drawer portion 32 may be configured to provide power for the lifting of the lifting member 35 when being coupled to each other. The lifting assembly 40 for lifting the lifting member 35 may be positioned on each of the front panel 31 and the drawer portion 32, and may have a structure that may be selectively connected according to whether the front panel 31 and the drawer portion 32 are separated from or coupled to each other.

To this end, the lifting assembly 40 may include a door side device 41 provided in the front panel 31 and a drawer side device 50 provided in the drawer portion 32. The door side device 41 may be provided inside the front panel 31, and a door connection member 416, included in the door side device 41, may be exposed to the rear surface of the front panel 31. The drawer side device 50 may be provided in the drawer portion 32, and a drawer connection member 522 may be provided to be exposed to a position corresponding to the door connecting member 416 on a front surface of the drawer portion 32.

The door connecting member 416 and the drawer connection member 522 may be configured to be coupled to and separated from each other in a corresponding manner, and to be able to transmit power in the coupled state. The door connecting member 416 and the drawer connection member 522 may be coupled to each other when the front panel 31 is fixed to the drawer portion 32, and the door connecting member 416 and the drawer connecting member 522 may be separated from each other when the front panel 31 and the drawer portion 32 are separated from each other.

In addition, a lift motor 411 serving as a power source of the lift assembly 40 may be provided inside the front panel 31. A door cover 315 may be formed above the space in which the lift motor 411 may be provided. The door cover 315 may be provided on a rear surface of the front panel 31 and may be configured to shield the door side device 41 including the lift motor 411 provided on the front panel 31.

For example, the front panel 31 may have an outer shape formed with an outer case 311 forming a part of the front and circumferential surfaces, a door liner 314 forming the rear surface, and an upper decor 312 and a lower decor 313 forming the upper and lower surfaces. In addition, a heat insulating material may be filled in the front panel 31, and the front panel 31 may include a space in which the door side device 41 of the lift assembly 40 may be mounted.

The outer case 311 may be formed by bending a plate-shaped metal material, and an inclined portion 311*a* may be formed at a lower end of the front surface. An operation device hole 311*b* may be formed at one side of the inclined portion 311*a*, and the manipulation device 302 may be mounted in the manipulation device hole 311*b* for outputting a virtual switch and detecting a user's manipulation. The manipulation device 302 may include a projector light capable of outputting an image, and a proximity sensor to detect a user interaction with the projected image. In addition, the lower decor 313 may include a manipulation unit bracket 313*a* for mounting the manipulation device 302 and arranging wires connected to electrical components inside the front panel 31.

The door liner 314 may be injection-molded with a plastic material, and a recessed portion 314*a* may be formed so that the door side device 41 including the lift motor 411 may be mounted. The door liner 314 may include a door cover 315 to shield the door side device 41 and the recessed portion 314*a* mounted on the front panel 31. A connection member hole 315*a* may be formed on the rear surface of the front panel 31. The connection member hole 315*a* may be formed on the door cover 315, and the door connection member 416 may be exposed to the rear surface of the front panel 31 through the connection member hole 315*a*. In some examples, the door connection member 416 may be moved horizontally (e.g., in the front and rear direction) according to the user's manipulation, when the front panel 31 and the drawer portion 32 are separated from each other by the user's manipulation, the door connection member 416 and the drawer connection member 522 may be separated from each other.

The front panel 31 may include the door side device 41. The door side device 41 may include a motor assembly 412 including the lift motor 411 and gears provided inside the case, a door side shaft 413 rotated by the motor assembly 412, a first door side gear 414 of a bevel gear shape provided at both ends of the door side shaft 413, and a second door side gear 415 of a bevel gear shape coupled to the first door side gear 414 and the door connection member 416, as configurations positioned in the front panel 31 of the lift assembly 40. The door side device 41 will be described in more detail below.

The motor assembly 412 provides power for the lifting of the lifting member 35, and may be oriented to extend horizontally with the front surface of the front panel 31 to minimize the recessed space inside the front panel 31. In addition, the door side shaft 413 connected at both sides of the motor assembly 412 may be connected to the lift motor 411 to enable simultaneous rotation.

In some examples, a pair of door frames 316 may be provided on both left and right sides of the rear surface of the front panel 31. The door frame 316 may be configured to connect the front panel 31 and the drawer portion 32. In addition, a gasket 317 may be provided around the rear surface of the door liner 314, the gasket being in contact with the front end of the cabinet 10 to cause the storage space to be hermetically sealed.

Figure 5:
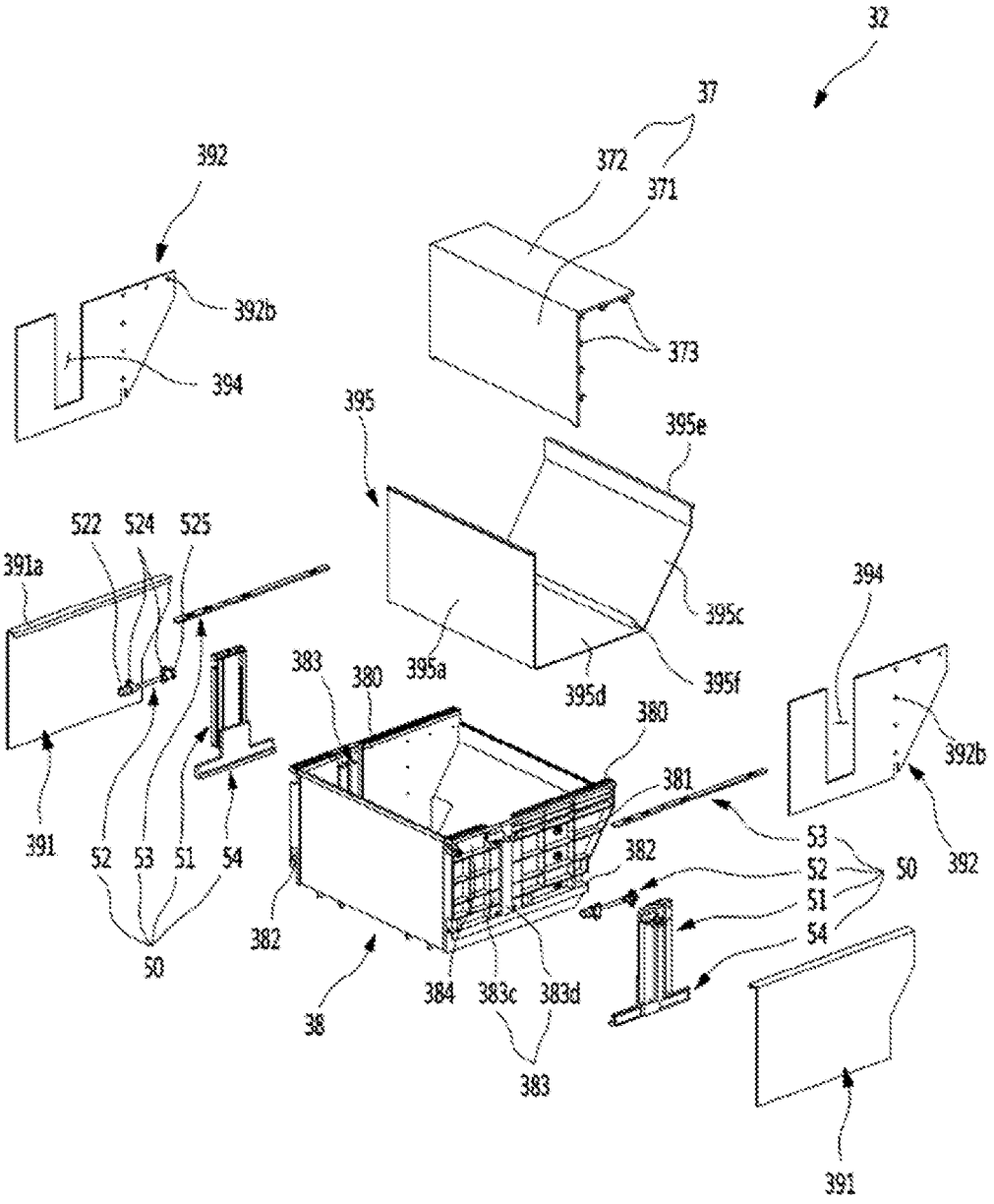
FIG. 5 may be an exploded perspective view of a drawer portion of the drawer.

FIG. 5 may be an exploded perspective view of a drawer portion of the drawer. As shown in the drawing, the drawer portion 32 may include a drawer body 38 forming the overall shape of the drawer portion 32, a drawer side device 50 provided in the drawer body 38 and constituting the lift assembly 40, and a plurality of plates 391, 392, and 395 forming an inner shape of the drawer portion 32.

The drawer body 38 may be injection-molded from a plastic material, and may form the overall shape of the drawer portion 32. In addition, the inner and outer shapes of the drawer portion 32 may be formed by the plurality of plates 391, 392, and 395. The drawer body 38 may have a basket shape with the top opened to have a food storage space formed therein.

The rack 34 may be provided on both left and right sides of the bottom surface of the drawer portion 32. The drawer portion 32 may be opened and closed in the front and rear direction by the rack 34. For example, at least a portion of the drawer portion 32 may be positioned in the storage space when the drawer portion 32 is mounted in the cabinet 10. In addition, the rack 34 may be coupled to the pinion gear 141 provided on the bottom surface of the storage space. Therefore, when the opening/closing motor 14 is operated, the pinion gear 141 may be rotated so that the rack 34 may be moved and the lower drawer 30 may be opened and closed.

A plurality of reinforcing ribs 381 may extend in both horizontal and vertical directions on both left and right sides of the drawer body 38. The reinforcing rib 381 may prevent the drawer body 38 from being deformed by loads applied to the left and right sides of the drawer body. For example, a device for the lifting of the lifting member 35, such as the rail assembly 51, may be provided on both sides of the drawer body 38. Accordingly, loads may be concentrated on both sides of the drawer body 38 when the lifting member 35 and the food or container seated on the lifting member 35 may be raised. The reinforcing ribs 381 may maintain the shapes of the drawer body 38 and the drawer portion 32 even under a concentrated load.

In some examples, the drawer body 38 may have a rail mounting part 382 formed at the lower parts of both sides thereof, the rail mounting part 382 being provided with the rail 33 to guide the opening/closing of the drawer body 38. The rail mounting part 382 may extend from the front end to the rear end, and a space may be formed to receive the rail 33 therein. The rail 33 may be a rail extending in multiple stages, one end of which may be fixed to a storage space inside the cabinet 10, and the other end of which may be fixed to the rail mounting part 382 to make it possible to open and close the lower drawer 30 in a more stable manner. The rail mounting part 382 may be located in an inner region of a drawer flange 380, which will be described below, and may be hidden by an outside plate 391.

In some examples, the drawer body 38 may have a mounting part 383 recessed inside both sides thereof, the mounting part 383 being included in the rail assembly 51 of the drawer side device 50. The mounting part 383 may be recessed outwards from an inner surface of the drawer body 38 forming the drawer space.

The mounting part 383 may extend vertically, and may extend vertically from the top of the drawer body 38 toward the bottom surface of the drawer body 38. Herein, the lower end of the mounting part 383 may be located above the lower ends of both sides of the drawer body 38. The lower end of the mounting part 383 may extend to the rail mounting part 382, and thus may be formed so as not to interfere with the components for mounting the rail 33 and the rail 33.

In addition, the mounting part 383 may be configured so that an inner surface thereof may be formed in a shape corresponding to the outer surface shape of the rail assembly 51, whereby a stable mounting of the rail assembly 51 may be enabled even under a load. For example, the mounting part 383 may be formed in multiple stages to correspond to the outer surface of the rail assembly 51, and may be restrained without being rotated in a state that the rail assembly 51 having the corresponding shape may be mounted. In addition, the rail assembly 51 may form a same plane as the inner surface of the drawer body 38 when mounted on the mounting part 383, thereby preventing interference and giving a sense of unity when the lifting member 35 may be raised. In addition, a mounting part bracket 53 may be provided on the opened top surface of the mounting part 383. The mounting part bracket 53 may be formed of a metal material to restrain the upper end of the rail assembly.

The rail assembly 51 may be connected to both ends of the lifting member 35 by a connecting bracket 54. In addition, the rail assembly 51 may be operated to allow the lifting member 35 to be moved up and down, and may be configured to guide smooth up and down movements of the lifting member 35.

The shaft mounting part 384 may be opened outwardly from upper ends of both sides of the drawer body 38, and may be formed to communicate with the mounting part 383. Accordingly, the drawer side shaft 52 mounted on the shaft mounting part 384 may be coupled to the rail assembly 51 mounted on the mounting part 383 to enable power transmission.

In some examples, the mounting part 383 and the shaft mounting part 384 may be located inside an area of the drawer flange 380 that may be bent outwardly from upper ends of both sides of the drawer body 38. For example, the mounting part 383 and the shaft mounting part 384 may be located below the area bent outwardly of the drawer flange 380. In addition to the mounting part 383 and the shaft mounting part 384, the rail assembly 51 and the drawer side shaft 52 mounted on the mounting part 383 and the shaft mounting part 384 do not protrude inward or outward farther than the drawer flange 380. Both the drawer side device 50 constituting a part of the lift assembly 40 and the structure for mounting the drawer side device 50 may be located in the area of the drawer flange 380. Therefore, it may be possible to prevent the loss of the storage space inside the drawer body 38. In addition, the reinforcing rib 381 and the rail mounting part 382 may be positioned inside the drawer flange 380.

An outer side plate 391 may be provided on both left and right sides of the outside of the drawer body 38. The outer side plate 391 may be mounted on both left and right sides of the drawer body 38 to form an outer shape of the both sides, and for example, may be configured so that components such as the drawer side shaft 52 and the rail mounted on both sides of the drawer body 38 may be prevented from being exposed to the outside.

In addition, a top bent portion 391*a* may be formed at the top of the outer side plate 391, and the top bent portion 391*a* may shield the tops of both sides of the drawer body 38 and the mounting part brackets 53.

The inner side plates 392 may be provided at both left and right sides of the inside of the drawer body 38. The inner side plate 392 may be mounted on both left and right sides of the drawer body 38, and may form the both left and right sides in the drawer body 38.

The extended end of the top bent portion 391*a* may be in contact with the top of the inner side plate 391, and thus, the inner side plate 392 and the outer side plate 391 may cause all the inner/outer and top surfaces of the both left and right sides of the drawer body 38 to be shielded.

In addition, a side opening 394 having a size corresponding to the mounting part 383 may be formed in the inner side plate 392. Accordingly, the rail assembly 51 mounted on the mounting part 383 may be exposed to the inside of the drawer body 38 in a state that the inner side plate 392 may be mounted, and may be mounted with the connection bracket 54 and thus coupled to the lifting member 35.

The drawer body 38 may include an inner plate 395 on inner front, bottom, and rear surfaces thereof. The inner plate 395 may include a front portion 395*a*, a bottom portion 395*b*, and a rear portion 395*c* having sizes and shapes corresponding to the inner front, bottom, and rear surfaces of the drawer body 38. The inner plate may be formed by bending a plate-shaped stainless material so as to form an inner surface of the remaining portion except the left and right sides of the drawer body 38. The both left and right ends of the inner plate 395 may be formed to contact the inner side plate 392. In other examples, the front portion 395*a*, the bottom portion 395*b*, and the rear portion 395*c* constituting the inner plate 395 may be separately configured to be coupled to or in contact with each other.

The inner side plate 392 and the inner plate 395 may form the entire inner surface of the drawer body 38, and the inner surface of the drawer body 38 may provide a metal texture. Therefore, the storage space inside the drawer portion 32 may have a metal texture as a whole, and not only allow the food stored therein to be coldly stored in a more even area, but also provide visually excellent cooling performance and storage performance to the user.

The drawer cover 37 may include a cover front portion 371 which partitions the inside of the drawer body 38 into a front space S1 and a rear space S2, and a cover top portion 372 which may be bent at a upper end of the cover front portion 371 to shield the rear space S2 from above.

For example, when the drawer cover 37 may be mounted, only the front space S1 where the lifting unit 80 may be positioned may be exposed in the drawer body 38, and the rear space S2 may be shielded by the drawer cover 37.

In some examples, a lifting member 35 may be provided inside the drawer body 38. The lifting member 35 may be included as a component of the lift assembly 40. The lifting member 35 may be formed with a size capable of being received inside the front space S1 of the bottom surface of the drawer body 38.

Hereinafter, with reference to the drawings, it will be described in more detail with respect to the structure of the lift assembly 40.

Figure 6:
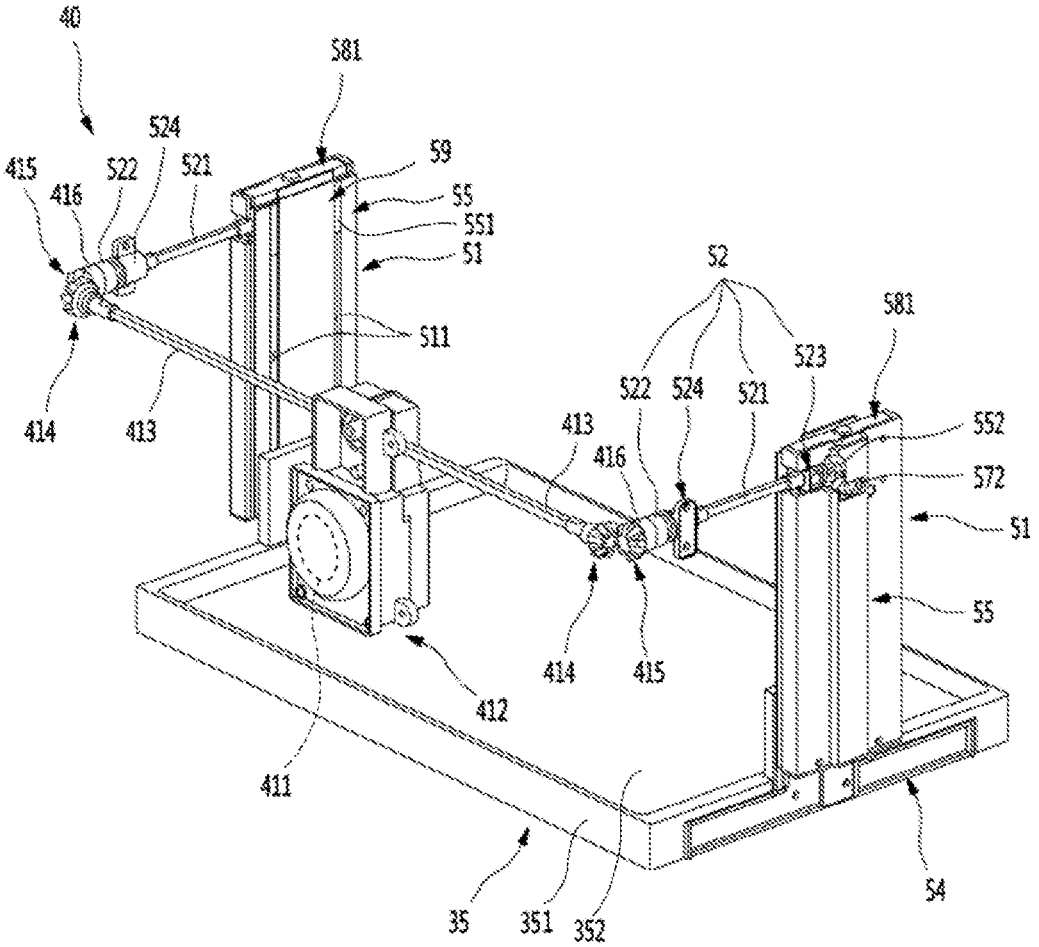
FIG. 6 may be a perspective view showing the configuration of a lift assembly built in the drawer.
Figure 7:
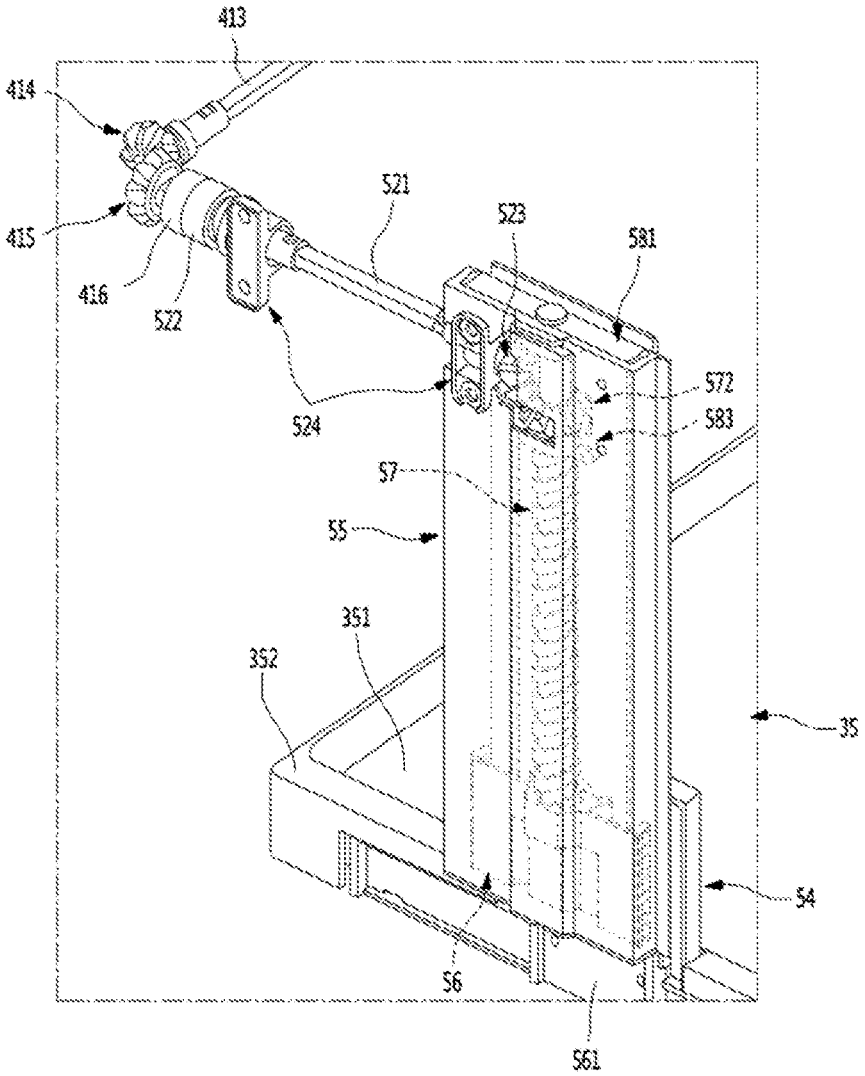
FIG. 7 may be a view showing a power transmission structure of the lift assembly.

FIG. 6 may be a perspective view showing the configuration of a lift assembly built in the drawer, and FIG. 7 may be a view showing a power transmission structure of the lift assembly.

As shown in the drawing, the lift assembly 40 may be composed of a door side device 41 positioned on the front panel 31 as a whole and a drawer side device 50 positioned on the drawer portion 32. In addition, the door side device 41 and the drawer side device 50 may be coupled to each other by the coupling of the front panel 31 and the drawer portion 32, resulting when power may be transmitted.

As described above, the door side device 41 may include a motor assembly 412 including a lift motor 411, a door side shaft 413 coupled to the motor assembly 412 to be rotated, first door side gears 414 provided at both ends of the door side shaft 413, second door side gears 415 engaged with the first door side first gear 414, and a door connection member 416 coupled to the second door side second gears 415.

Since the pair of rail assemblies 51 may be operated by the rotational force transmitted by the pair of second door side gears 415, the first door side gears 414 and the second door side gears 415 may be rotated simultaneously by the same amount, thereby preventing the lifting member 35 from tilting. To this end, the door side shaft 413 may be configured so that one shaft or multiple shafts passing through the motor assembly 412 may be rotated together.

As the lift motor 411 may be operated, the door side shaft 413 extending in both side directions rotates simultaneously at the same speed. In addition, the first door side gear 414 at the end of the door side shaft 413 may be engaged with the second door side gear 415 in a perpendicularly intersecting manner to each other, which results in a state capable of transmitting power. Accordingly, the second door side gear 415 rotated by the first door side gear 414 rotates the door connection member 416, and the drawer connection member 522 coupled to the door connection member 416 may be rotated together and thus rotational force may be transmitted to the drawer side device 50. As a result, the door side device 41 may be connected to the drawer side device 50 by the coupling of the front panel 31 and the drawer portion 32, and one lift motor 411 provided on the front panel 31 may operate components of the drawer side device 50 provided on both sides of the drawer portion 32.

The lifting member 35 may be formed in a rectangular plate shape, and may include a lifting plate 351 substantially supporting food or a container, and a lifting frame 352 supporting the lifting plate 351 from below and reinforcing strength. The lifting member 35 may be a part on which the food or container 36 may be substantially seated and supported, and may be referred to as a seating member or a tray.

The connection bracket 54 may be configured such that one side thereof may be fixed to the lifting frame 352 and the other side thereof may be coupled to the rail assembly 51. Therefore, when the rail assembly 51 is operated, the lifting frame 352 included in the lifting member 35 and connected by the connecting bracket 54 may move vertically together with the connecting bracket 54.

In some examples, the drawer body 38 may be equipped with the drawer side device 50 positioned in the drawer body 38 of the lift assembly 40. The drawer side device 50 may include the lifting member 35, the rail assembly 51 positioned at both sides of the lifting member 35 and mounted inside the mounting part 383, the connecting bracket 54, and the mounting part bracket 53 for restraining the drawer side shaft 52 and the rail assembly 51.

When the motor assembly 412 is operated, the rotational force of the door side shaft 413 may be transmitted to the drawer side device 50 by the door connection member 416 and the drawer connection member 522 coupled to each other. The drawer connection member 522 may be rotated so that the drawer side shaft 52 may be rotated and then the lifting shaft 57 inside the rail assembly 51 coupled to the drawer side shaft 52 may be rotated.

The lifting shaft 57 may be rotated so that a block holder 56 coupled to the lifting shaft 57 may be moved vertically. The block holder 56 may be coupled to the connection bracket 54 so that the connection bracket 54 may be raised, and the lifting member 35 may be moved up and down when the connection brackets 54 on both left and right sides may be coupled to the lifting frame 352.

For example, the rotational force of the motor assembly 412 may be transmitted to the drawer side shaft 52 through the door side shaft 413 to rotate the lifting shaft 57, and the block holder 56 and the connecting bracket 54 may guide the lifting member 35 to be moved in a vertical direction.

Considering the configuration of the drawer side device 50 according to the vertical direction of the lifting member 35 in more detail, the drawer side device 50 may include the rail assembly 50 for movement, the drawer side shaft 52 connected to the rail assembly 50 and the door side device 41 to transmit power, and the connection bracket 54 for connecting the rail assembly 50 and the lifting member 35. The rail assembly 51 may be positioned at a position corresponding to the center of the front space S1 in the front and rear direction, and may be positioned at a position corresponding to the center of the lifting member 35 in both side surfaces. Therefore, the lifting member 35 may be stably raised without tilting.

The rail assembly 51 may be mounted to the mounting part 383, and may be configured therein to include a rail housing 55 forming a space therein, an upper cap 581 and a lower cap 585 shielding an upper end and a lower end of the rail housing 55, respectively, a block holder 56 moved along the lifting shaft 57 in the rail housing 55, and a rail cover 59 shielding one open surface of the rail housing 55. The rail housing 55 and the rail cover 59 may form a pair of guide slits 511 extending in the vertical direction, and the lifting block and the block holder 56 may be raised along the pair of guide slits 511. In addition, the rail housing 55 may be formed of a plate-shaped metal material, and may be configured so that a center thereof is protruded, and both side ends of the center portion may extend in a stepped state. In addition, the rail housing 55 may be formed with a space to have the lifting shaft 57 and the block holder 56 received therein.

For example, the rail housing 55 may be formed therein with a space in which both ends of the block holder 56 are received, and a center portion of the block holder 56 may be protrude through a housing opening 551 opened in the rail housing 55. The block holder 56 may be formed to be movable along the housing opening 551.

The rail housing 55 may be provided at an upper portion with a shaft insertion hole 552 in which an end portion of the drawer side shaft 52 extending toward the rail assembly 51 may be received. The shaft insertion hole 552 may be formed to be opened in a corresponding shape to allow the end of the drawer shaft 521 and a drawer side gear 523 to be inserted, and opened to be exposed to a part of the lifting shaft 57 coupled to the upper end of the lifting shaft 57. Therefore, the shaft insertion hole 552 enables monitoring of the mounting of the drawer side shaft 52 and the coupling state of the drawer side gear 523 and the shaft gear 572.

The lifting shaft 57 may be received inside the rail housing 55 and may be located at the central portion 553. In addition, the lifting shaft 57 may have a thread 571 formed on an outer circumferential surface thereof so that the lifting block 567 may be moved vertically along the lifting shaft 57 when the lifting shaft 57 is rotated. The lifting shaft 57 may extend in a vertical direction from the inside of the rail housing 55, and an upper end and a lower end of the lifting shaft 57 may be rotatably supported inside the rail housing 55. The thread 571 may be formed between the upper end and the lower end of the lifting shaft 57.

In addition, a shaft gear 572 may be provided at an upper portion of the lifting shaft 57, such as an upper end of the thread 571. The shaft gear 572 may be positioned at an upper end of the thread 571 and may be configured to be integrally coupled to and thus rotated together with the lifting shaft 57. In addition, the shaft gear 572 may be gear-engaged with the drawer side gear 523 in such to be perpendicularly intersected with the drawer side gear 523 mounted on the drawer side shaft 52, and may receive power from the drawer side shaft 52.

The block holder 56 may be formed with a center opening, and may be formed in a shape corresponding to an inner space of the rail housing 55 to guide movement in the vertical direction along the rail housing 55 when the lifting shaft 57 is rotated. The outer surface of the block holder 56 may be formed to correspond to the inner surface shape of the rail housing 55. For example, the central portion of the block holder 56 may protrude to be inserted into the central portion of the rail housing 55, and the block holder 56 may have a structure in which both sides thereof protrude laterally to be received inside both sides of the rail housing 55. In addition, the inner surface of the block holder 56 protrudes through the housing opening 551 to be exposed into the drawer portion 32 and may be coupled to the lifting member 35 or the connection bracket 54.

For example, the outer surface shape of the block holder 56 and the inner surface shape of the rail housing 55 corresponding thereto may be formed to be bent or stepped in multiple stages, so that when lifting the lifting member 35, it the load may be distributed in the left and right direction or in the front and rear direction and applied to the rail assembly 50, thereby ensuring stable lifting.

In addition, the block holder 56 may include, on both sides, a rolling member 568 composed of a plurality of ball bearings positioned in the vertical direction. The rolling member 568 may be interposed between both side surfaces of the block holder 56 and the inner surface of the rail assembly 50 to make the lifting of the block holder 56 more smoothly. For example, the rail assembly 50 allows the block holder 56 to be moved vertically by the rotation of the lifting shaft 57, and the block holder 56 may be connected to the lifting member to the lifting member 35 to provide the power for the lifting of the lifting member 35. At the same time, the block holder 56 having a stepped shape may be guided to be moved along the rail assembly 51 inside the rail assembly 51, so that the rail assembly 51 guides the smooth lifting of the lifting member 35.

The block holder may have a hollow space formed therein to receive the rail cover 59 therein. The block holder 56 may be vertically moved along the guide slit 511 formed by the rail cover 59 and the rail housing 55. The rail cover 59 may shield the housing opening 551 and form the guide slit 511. For example, the rail cover 59 may be formed of the same plate-like metal material as the inner side plate 392.

The rail cover 59 may shield the housing opening 551 and thus shield components that may be received inside the rail housing 55. To this end, the rail cover 59 may be located in an area of the housing opening 551, and both ends of the rail cover may be bent inwardly of the rail housing 55 and then bent outwards to form the guide slits 511. In addition, the block holder 56 may be vertically moved along the guide slit 511.

The rail cover 59 may have a cross-sectional shape corresponding to the hollow shape inside the block holder 56 to pass through the hollow of the block holder 56. Accordingly, the block holder 56 may be moved vertically while penetrated by the rail cover 59.

The width of the rail cover 59 exposed inwardly of the housing opening 551 may be formed smaller than that of the housing opening 551. For example, when the rail cover 59 may be mounted, the guide slit 511 extending in the vertical direction may be formed. The distance between both side ends of the rail cover 59 inside the rail housing 55 may be greater than the distance of the housing opening 551. The drawer portion 32 on which the rail assembly 51 may be mounted may be configured so that the inner side surface of the drawer portion 32, except for the gap by the guide slit 511 may be covered by metal material, thereby improving the appearance.

The drawer side shaft 52 may be positioned in the shaft mounting part 384. The drawer side shaft 52 may include the drawer shaft 521, a drawer connection member 522 in front end of the drawer shaft 521, a drawer side gear 523 in rear end of the drawer shaft 521, and a shaft fixing member 524 for causing the drawer shaft 521 to be rotatably fixed on the shaft mounting part 384.

For example, the drawer connection member 522 may be coupled to the front end of the drawer shaft 521, and the drawer connection member 522 may be exposed on both sides of the front surface of the drawer portion 32. As described above, the drawer connection member 522 may be coupled to the door connection member 416 when the front panel 31, and the drawer portion 32 may be coupled to each other, thereby to be rotated together according to the driving of the door side device 41.

A drawer side gear 523 may be provided at the rear end of the drawer shaft 521. The drawer side gear 523 may be formed in a bevel gear shape, and may pass through the rail housing 55 to be coupled to the shaft gear 572. For example, the drawer side shaft 52 and the lifting shaft 57 positioned to cross each other perpendicularly may be connected to each other by the drawer side gear 523 and the shaft gear 572, thereby enabling power transmission.

The drawer side shaft 52 may include a shaft fixing member 524. A pair of shaft fixing members 524 may be provided on both left and right sides, and may serve to support the drawer side shaft 52 so that the drawer side shaft 52 may be rotated in a state that may be not tilted.

In some examples, in addition to the drawer side device and the door side device described above, various other structures for the lifting of the drawer portion may be possible. Also, the structure lifting may be omitted.

Figure 8:
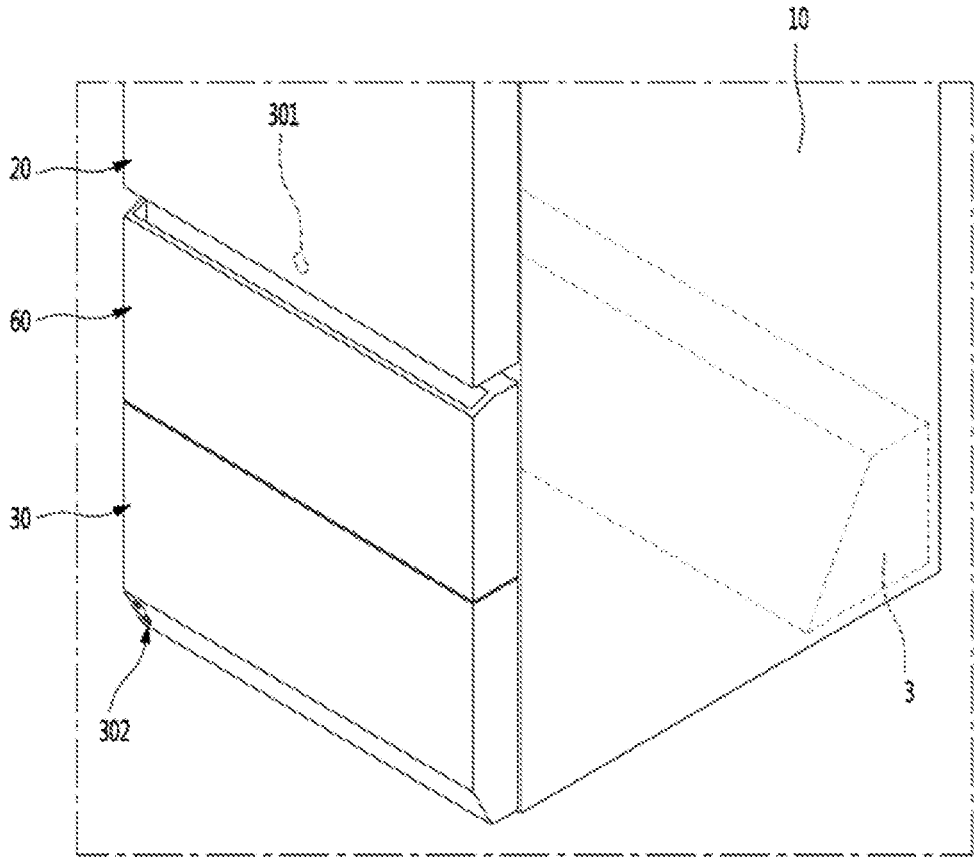
FIG. 8 may be a perspective view showing a state in which a drawer may be closed.

Hereinafter, a drawer 2 of a refrigerator 1 according to an embodiment and having the structure as described above may be opened/closed and raised, as will be described in more detail with reference to the accompanying drawings. FIG. 8 may be a perspective view showing a state in which a drawer may be closed. As shown in the drawing, a refrigerator 1 may have both a swinging door 20 and a drawer 2 maintaining a closed state when food may be stored. In such a state, the user may open and close the drawer 2 to store the food.

A plurality of drawers 2 may be provided vertically (e.g., above and below), and may be opened by a user's manipulation. Herein, the user's manipulation may be performed by touching the manipulation unit 301 provided on the front surface of the swinging door 20 or the drawer 2, and performed by entering the opening manipulation via the manipulation device 302 provided in the drawer 2. The manipulation unit 301 may be installed at the upper swinging door 20. In addition, the manipulation unit 301 and the manipulation device 302 may be configured to individually manipulate the opening/closing of the drawer 2 and the lifting of the lifting member 35, respectively. In other examples, it will also be possible for the user to open the drawer while grasping the door handle. Although an example of opening and lifting the lowermost door 30 of the drawers 2 positioned above and below may be described in the following description, the drawers 2 positioned above and below may be all opened and raised in a corresponding manner.

Figure 9:
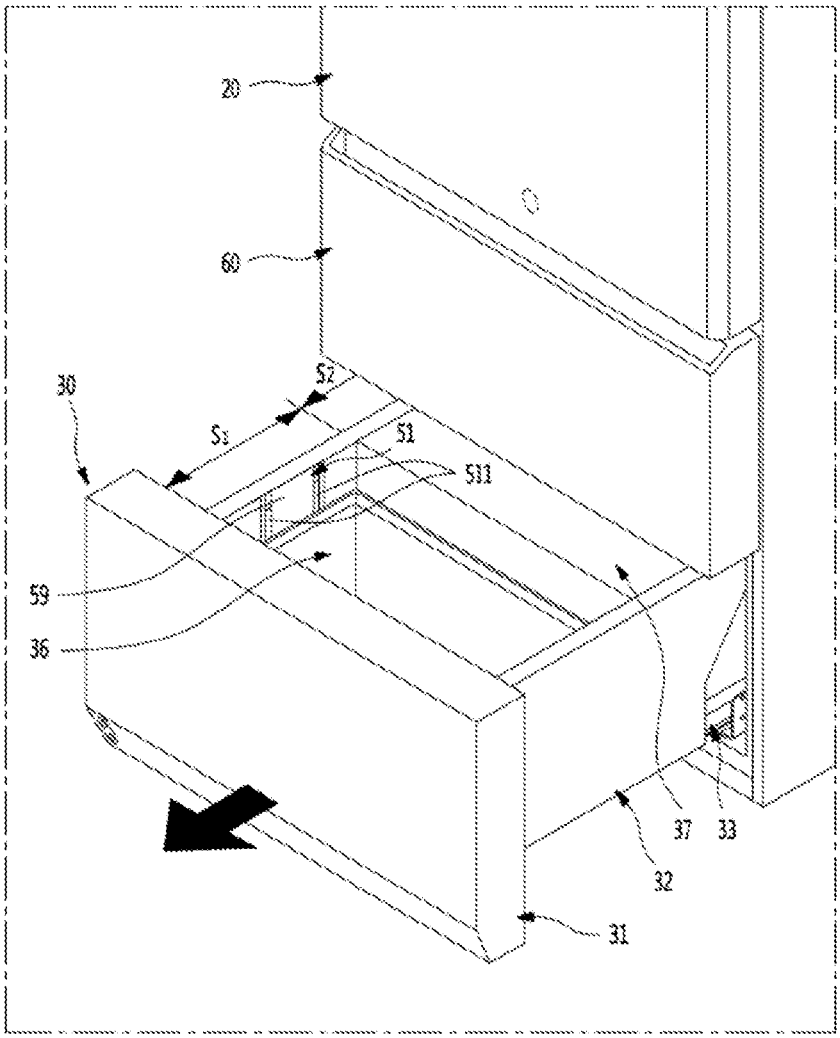
FIG. 9 may be a perspective view showing the lower drawer when fully opened.
Figure 10:
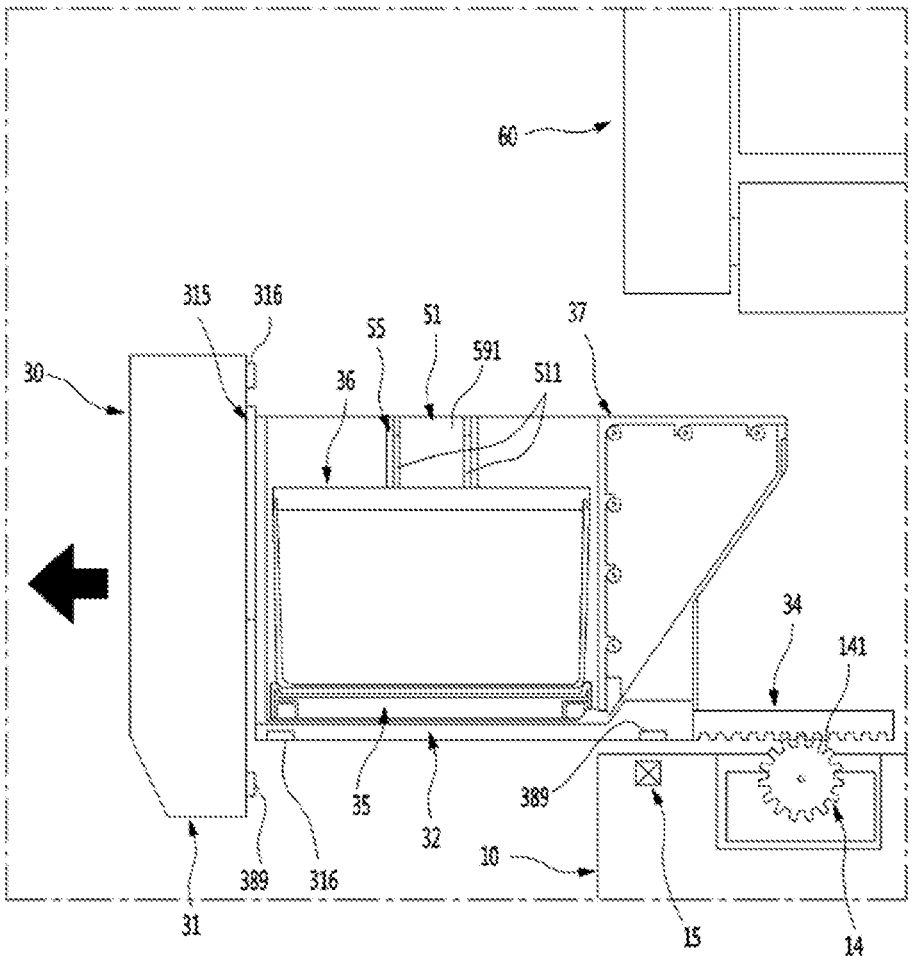
FIG. 10 may be a cross-sectional view of the lower drawer when fully opened.

FIG. 9 shows a perspective view showing a state where the lower drawer may be fully opened according to an embodiment of the present disclosure, and FIG. 10 shows a cross-sectional view of the lower drawer when opened. As shown in the drawings, the lower drawer 30 may be opened forward according to the user's opening manipulation of the lower drawer 30. The lower drawer 30 may be opened while the rail 33 extends.

In some examples, the lower drawer 30 may be configured to be opened and closed by the driving of the opening/closing motor 14, rather than a user manually pulling to open the door. The rack 34 provided on the bottom surface of the lower drawer 30 may be coupled to the pinion gear 141 which may be rotated when the opening/closing motor 14 provided in the cabinet 10 may be operated, whereby the lower drawer 30 may be opened and closed according to the driving of the opening/closing motor 14.

The lower drawer 30 may be opened up to at least a distance enough to allow the front space S1 inside the drawer portion 32 to be completely exposed to the outside. Therefore, in such a state when the drawer 30 is fully extend, when the upper drawer 60 is closed, the lifting member 35 will not be interfered with when rising. Herein, the opening distance of the lower drawer 30 may be made by the open/close detecting part 15 positioned in the cabinet 10 and/or the lower drawer 30. The open/close detecting part 15 may be configured as a sensor detecting a magnet 389 to detect a state in which the lower drawer 30 may be completely opened or closed.

For example, as shown in the drawings, the magnet 389 may be provided at the bottom of the drawer portion 32, and the sensor may be provided in the cabinet 10. As another example, the magnet 389 may be provided on one side of both sides of the drawer portion 32, and the sensor may be provided in the cabinet 10 at a position corresponding thereto. The magnet and the sensor may be installed anywhere as long as opening/closing of the lower drawer 30 and the opening completion and closing completion may be detected.

The open/close detecting part 15 may be provided at a position corresponding to a position of the magnet 389 in a state where the lower drawer 30 may be closed and a position of the magnet 389 in a state where the lower drawer 30 may be completely opened. Therefore, the open/close state of the lower drawer 30 may be determined by the open/close detecting part 15.

In addition, a switch may be provided at each position at which the lower drawer 30 may be completely closed and opened, as needed, to detect opening/closing of the lower drawer 30. Alternatively, the opening/closing of the lower drawer 30 may be detected by counting the rotation speed of the opening/closing motor 14 or using a sensor measuring the distance between the rear surface of the front panel 31 and the front end of the cabinet 10.

When the lower drawer 30 moves to be completely opened, the lift motor 411 may be operated to allow the lifting member 35 to be raised. The lifting member 35 may be configured to operate in a situation in which the lower drawer 30 may be sufficiently opened to ensure safe lifting of the food or container 36 seated on the lifting member 35. For example, when the lower drawer 30 opens so that the front space may be completely exposed to the outside, the lifting member 35 may be raised while preventing the container 36 or the food seated on the lifting member 35 from interfering with the upper drawer 60.

The lifting member 35 may start to be raised when the complete opening of the lower drawer 30 is to be checked. In addition, the lifting member 35 may start to be raised after a predetermined time elapses after the opening of the lower drawer 30 may be checked in order to ensure the user's safety and prevent damage of the stored food. In other examples, after the opening of the lower drawer 30, the user may directly request the raising of the lifting member 35 by manipulating the manipulation unit 301. For example, the manipulation unit 301 may be manipulated to open the lower drawer 30, and then may be re-manipulated to lift the lifting member 35. In addition, the lower drawer 30 may be manually opened and closed by the user, and after the lower drawer 30 moves to an open position, the manipulation unit 301 may be used to receive an input to initiate the lifting member 35 being raised.

Figure 11:
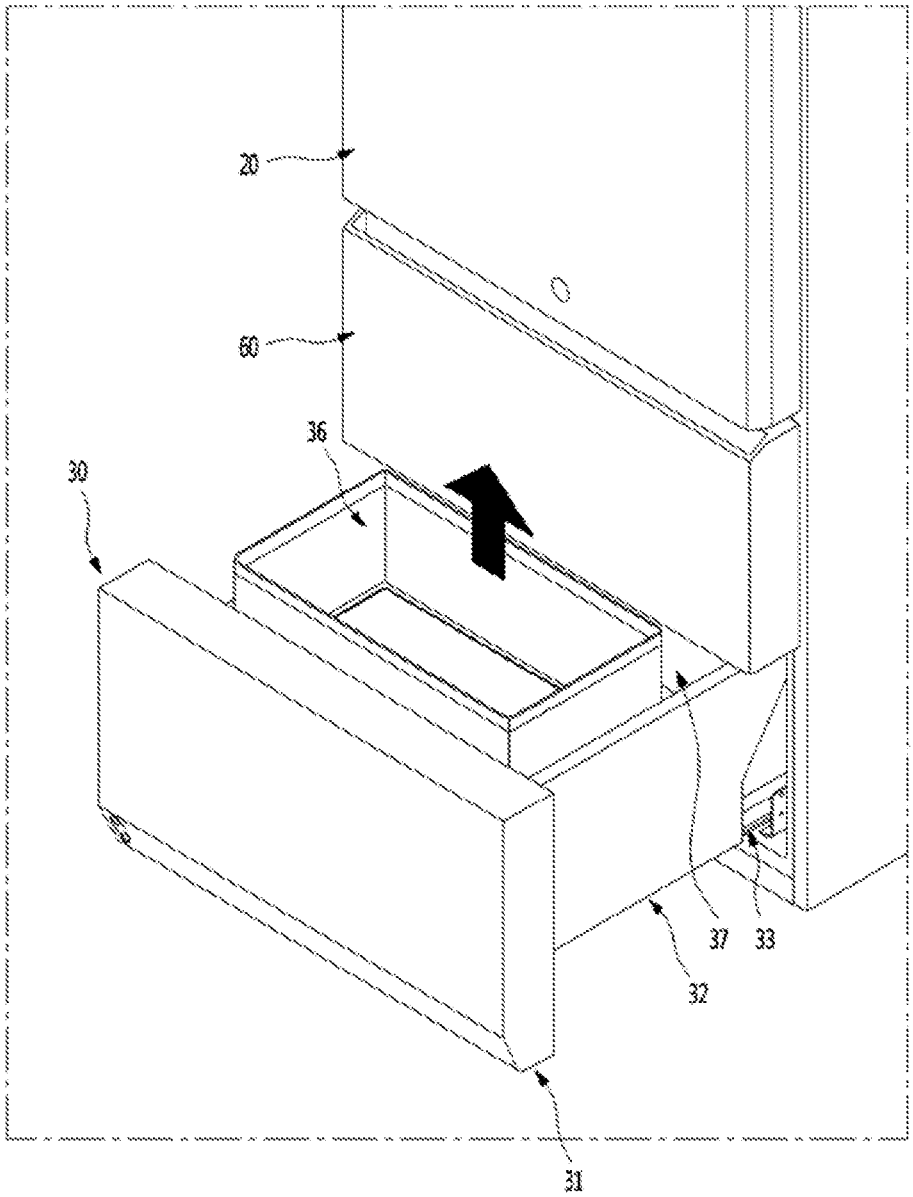
FIG. 11 may be a perspective view showing the lifting member of the lower drawer when completely raised.
Figure 12:
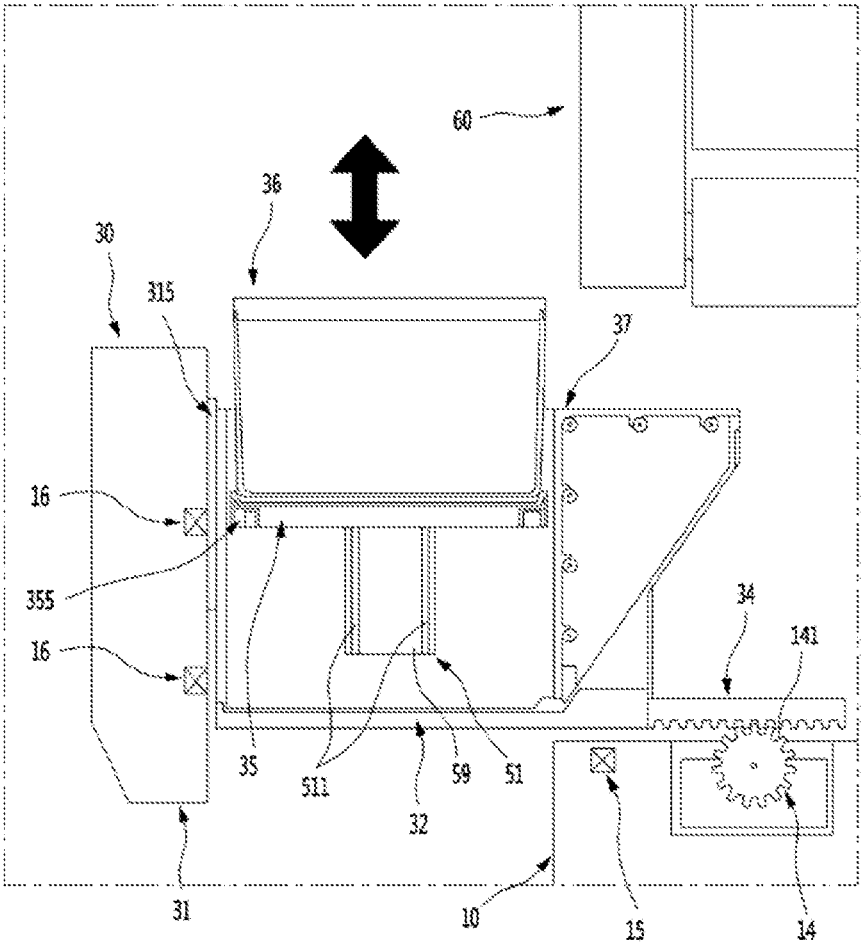
FIG. 12 may be a cross-sectional view of the lower drawer when the lifting member may be completely raised.

FIG. 11 shows perspective view showing a state in which the lifting member of the lower drawer may be completely raised, and FIG. 12 shows a cross-sectional view of the lower drawer in the state shown in FIG. 11. As shown in the drawings, when the lower drawer 30 opens, the lifting member 35 may be raised. The lifting member 35 may be raised by operating the lift motor 411, and power may be transmitted in a state that the door side device 40 of the front panel 31 and the drawer side device 50 of the drawer portion 32 may be coupled to each other to enable the lifting member 35 to be raised. For example, when the lift motor 411 may be operated, the door side shafts 413 on both sides connected to the lift motor 411 may be rotated, and the door side first gear 414 connected to the door side shaft 413 may be rotated.

The first door side gear 414 may rotate the door connection member 416 exposed to both sides of the rear surface of the front panel 31 when the first door side gear 414 may be perpendicularly gear-engaged with the second door side gear 415. For example, the gears of the first door side gear 414 and the second door side gear 415 may be gear-engaged with each other so that the direction of the rotation axis may be vertically converted.

The rotational force of the door side device 41 may be transmitted to the drawer side device 50 by the door connection member 416 and the drawer connection member 522 connected to each other. For example, the drawer connection member 522 coupled with the door connection member 416 may be rotated, and the drawer side gear 523 at the end of the drawer side shaft 52 may be rotated due to the rotation of the drawer connection member 522.

The rotational force may be transmitted when the drawer side gear 523 and the shaft gear 572 connect perpendicularly to each other, and thus the rotational force of the drawer side shaft 52 may rotate the lifting shaft 57. For example, the lifting shafts 57 of the rail assemblies 50 positioned at both sides of the drawer portion 32 may be rotated at the same time, and the block holder 56 at both sides may move vertically along the lifting shaft 57.

The block holder 56 may be moved upward together with the connecting bracket 54 while being coupled with the connecting bracket 54, and the lifting member 35 coupled with the connecting bracket 54 may be also moved upward. Herein, the connection bracket 54 may be connected to the center of both sides of the lifting member, and the rail assembly may be also positioned in the center of the lifting member so that the lifting member 35 may be stably raised without tilting. The lifting member 35 may be continuously raised up to a height enough to facilitate access to the food or container seated on the lifting member 35, so that the user may easily pick up the food or container.

The raising height of the lifting member 35 may be increased until the block holder 56 arrives at an upper end of the lifting slot. Then, when the raising of the lifting member 35 is completed, the driving of the lift motor 411 may be stopped. When the raising completion signal of the lifting member 35 is input, the driving of the lift motor 411 may be stopped, and for this purpose, a height sensor 16 capable of detecting the position of the lifting member 35 may be provided. The height sensor 16 may be provided in the front panel 31 and may be provided at heights corresponding to the highest rising position of the lifting member 35 and the minimum lowering position of the lifting member 35.

The height sensor 16 may be configured as a sensor for detecting the magnet 355, and may detect the magnet 355 provided in the lifting member 35 to determine whether the raising of the lifting member 35 is completed. In addition, the height sensor 16 may be configured to have a switch structure to turn on the switch when the lifting member 35 is raised at a maximum height. In addition, the height sensor 16 may be provided on the lifting rail 44 or the lifting shaft 57 to detect the position where the lifting member 35 is raised at the maximum height. In addition, whether the lifting member 35 is raised at maximum height may be determined according to a change in the load applied to the lift motor 411.

In other examples, the height sensor 16 may detect whether the lifting member 35 is raising or lowering. For example, when the magnet 355 may be not detected at both the maximum raising position and the maximum lowering position of the lifting member 35, it may be detected that the lifting member 35 is being raised. Also, when the magnet 355 is no longer detected after the magnet 355 is detected at the maximum raising position, it may be deduced that the lifting member 35 is being lowered. On the contrary, when the magnet 355 is no longer detected after the magnet 355 is detected at the maximum lowering position, it may be determined that the lifting member 35 is being raised.

When the lifting member 35 is raised to the maximum height, the lift motor 411 may be stopped. In this state, the lifting member 35 may be located inside the drawer portion 32, but the food or container 36 seated on the lifting member 35 may be positioned higher than the opened top surface of the drawer portion 32, thereby allowing the user to easily access the food. For example, since the user does not need to excessively bend forward to pick up or access the container 36, safer and more convenient operation may be possible.

After the user completes the food storing operation, he/she may manipulate the manipulation unit 301 to initiate a lowering of the lifting member 35. The lowering of the lifting member 35 may be made by reverse rotation of the lift motor 411, and may be made slowly through a process opposite to the above process.

When the lowering of the lifting member 35 is completed, the lifting member 35 may be in a state as illustrated in FIG. 9 or 10, and the lowering completion of the lifting member 35 may be made by the height sensor 16. The height sensor 16 may be further provided at a corresponding position to detect the magnet provided in the lifting member 35 when the lifting member 35 is positioned at the lowest position. Therefore, the lift motor 411 may be stopped when the lowering completion of the lifting member 35 is detected.

The lower drawer 30 may be closed after the lift motor 411 stops. Herein, the lower drawer 30 may be manually closed by a user, or may be closed by driving of the opening/closing motor 14. An example of the the lower drawer 30 when completely closed is shown in FIG. 8. In some situations, the container 36 or the food of the lower drawer 30 being moved upward may collide with the upper drawer 60 when the upper drawer 60 is opened when the lower drawer 30 is opened and being raised. In order to prevent this impact, the upper drawer 60 may include an upper drawer restraint device 70 for restraining the upper drawer 60 so that the upper drawer 60 may be not opened or may be opened only by a predetermined distance in a state where the lower drawer 30 is opened.

When the upper drawer 60 and the lower drawer 30 may be opened at the same time, there may be a problem that the refrigerator 1 falls forward due to the forward movement of the center of gravity. Accordingly, the upper drawer restraint device 70 restrains the upper drawer 60 to prevent the upper drawer 60 and the lower drawer 30 from being opened at the same time so that the refrigerator 1 does not fall forward.

In some examples, in order to prevent the upper drawer 60 and the lower drawer 30 from being opened at the same time, it may be also possible to control the opening/closing of the upper drawer 60 or the lower drawer 30 when the upper drawer 60 and the lower drawer 30 may be simultaneously opened. Hereinafter, the upper drawer restraint device 70 will be described in more detail with reference to the accompanying drawings.

Figure 13:
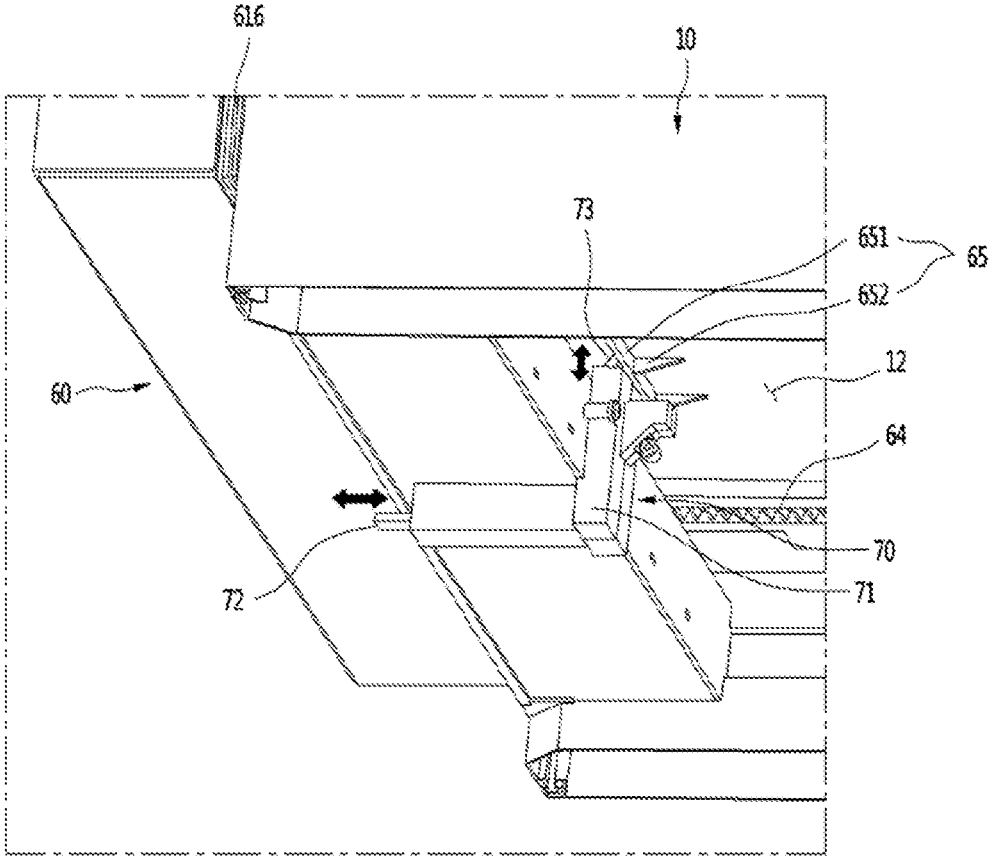
FIG. 13 may be a partially cutaway perspective view showing a mounting state of a door restraint device.

FIG. 13 shows a partially cutaway perspective view showing a mounting state of a door restraint device. As shown in the drawing, the partition member 18 may be provided inside the cabinet 10 of the refrigerator 1. The partition member 18 may be provided at the inner front end of the lower storage space 12 and extends from the left end to the right end to partition the front end of the lower storage space 12. The upper drawer 60 may be positioned above the partition member 18, and the lower drawer 30 may be arranged to be opened/closed.

The lower storage space 12 may be partitioned into the upper portion and the lower portion by the partition member 18. Alternatively, as shown, the lower storage space 12 may be configured such that the spaces in which the upper drawer 60 and the lower drawer 30 move communicate with each other, and the spaces for the upper drawer 60 and the lower drawer 30 may be partitioned by the partition member 18 only in the front end of the lower storage space 12.

The front end of the partition member 18 may be configured to be in contact with the rear surface of the front panel 31 of the upper drawer 60 and the lower drawer 30. For example, the gasket 316 on the rear surface of the front panel 31 of the upper drawer 60 and the lower drawer 30 may be in contact with the front surface of the partition member 18 so that the upper drawer 60 and the lower drawer 30 may be hermetically sealed with each other. In some examples, the door restraint device may be provided at one side of the partition member 18. The door restraint device may include an upper drawer restraint device (or upper drawer restraint latch) 70 that engages and restrains the upper drawer 60.

Considering the upper drawer restraint part 70, the upper drawer restraint part 70 may be configured to selectively restrain the upper drawer 60 depending on whether the lower drawer 30 may be opened or closed. The upper drawer restraint part 70 may be mounted at corners of the rear and bottom surfaces of the partition member 18 and may include a push member 72 pushed by the lower drawer 30 while the lower drawer 30 moves to be closed and a slider 73 which may be vertically moved by the push member 72. The slider 73 protrudes upward in the state in which the lower drawer 30 may be closed, and restrains the door restraint portion 65 of the upper drawer 60.

The door restraint portion 65 may be provided on a bottom surface of the upper drawer 60, and an installation position thereof may be changed. First, for example, the door restraint portion 65 may be formed at a position corresponding to the slider 73 in a state where the upper drawer 60 may be closed. As another example, when the upper drawer 60 move to be opened by a predetermined distance, the door restraint portion 65 may be provided at a position corresponding to the slider 73. In the former case, the upper drawer 65 may be restrained while the upper drawer 60 may be closed, so that the upper drawer 60 cannot be opened forward in the closed state, and in the latter case, the upper drawer 60 may be opened by the predetermined distance, but the upper drawer 60 may be restrained at the predetermined distance and no further opening may be possible. In the present embodiment, the predetermined distance may be 15 mm, and in other examples, may be longer or shorter than this.

In some examples, when the upper drawer 60 may be restrained by the upper drawer restraint part 70, the upper drawer 60 may be opened no further, but the closing may be possible. Accordingly, the user may manually open the upper drawer 60, and if necessary, the opening/closing motor 14 may be operated to close the upper drawer 60 when the restraint is detected.

The door restraint portion 65 may be composed of a restraint rib 651 extending downward and a reinforcing rib 652 extending in an intersecting direction in the rear of the restraint rib 651. When the upper end of the slider 73 contacts the front surface of the restraint rib 651 and the slider 73 and the door restraint portion 65 may be restrained, the upper drawer 60 may be restrained so as not to be opened forward.

Figure 14:
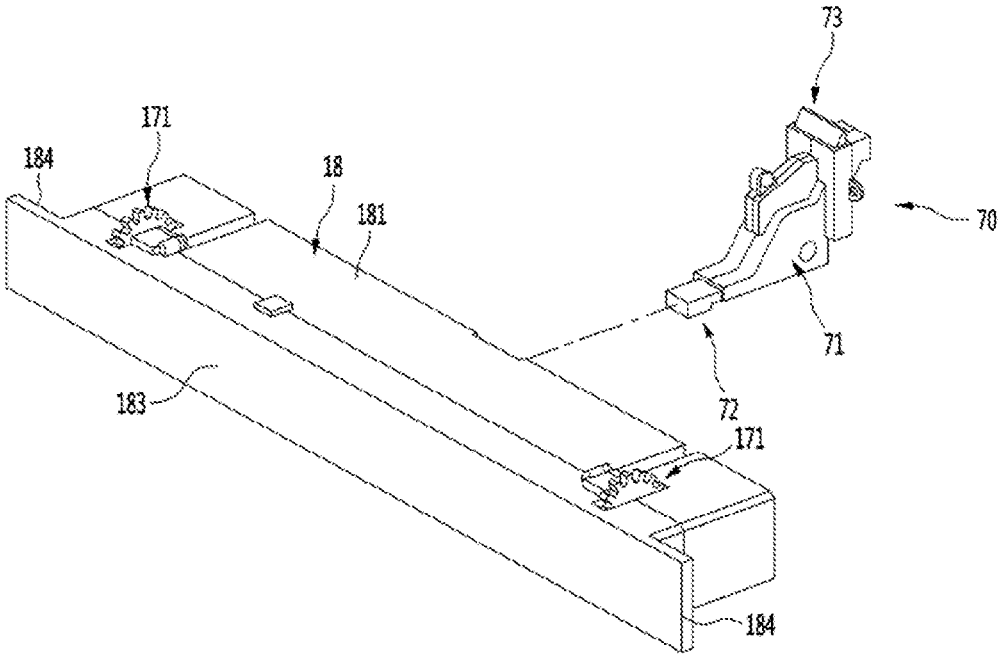
FIG. 14 may be an exploded perspective view of the mounting structure of the door restraint device viewed from the front.
Figure 15:
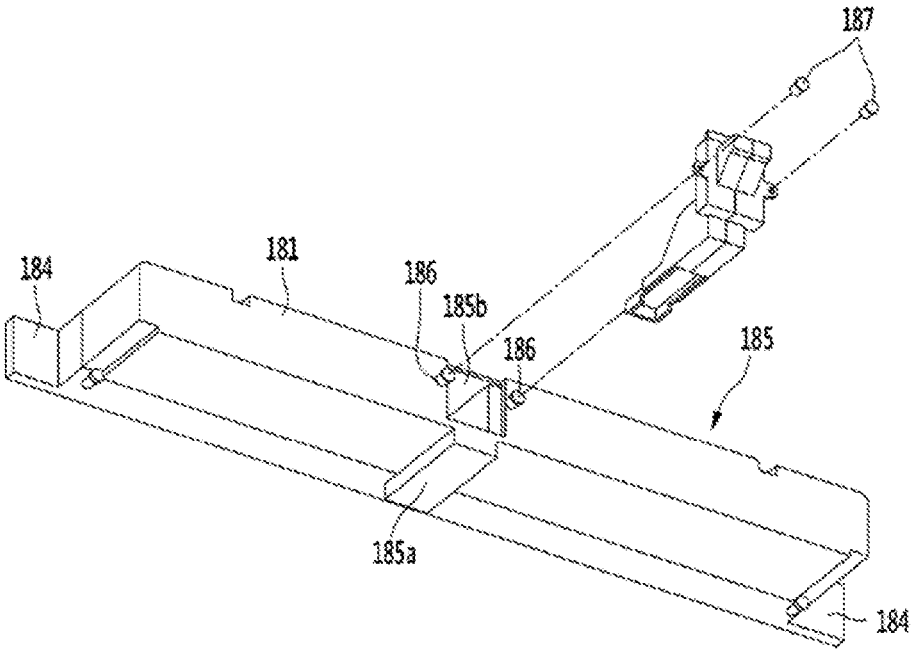
FIG. 15 may be an exploded perspective view of the mounting structure of the door restraining device viewed from the rear.

FIG. 14 shows an exploded perspective view of the mounting structure of the door restraint device viewed from the front, and FIG. 15 shows an exploded perspective view of the mounting structure of the door restraining device viewed from the rear. Referring to the drawings, the partition member 18 may have an outer shape formed by a partition member case 181 formed of a plastic injection molding, and insulating material 182 may be filled therein. In addition, a front plate 183 of a metal plate shape may be provided on the front surface of the partition member 18. Therefore, when the upper drawer 60 and the lower drawer 30 may be closed, the gasket and the front plate 183 may be in close contact with each other to allow the upper drawer 60 and the lower drawer 30 to be hermetically sealed to each other.

In some examples, the partition member 18 may have an upper opening/closing motor 17 and an upper pinion 171 provided therein. The upper opening/closing motor 17 and the upper pinion 171 may be provided at both sides of the partition member 18, respectively, and a pair of upper pinions 171 may be exposed through the top surface of the partition member 18 and thus gear-engaged with the upper rack 64 at the bottom surface of the upper drawer 60.

In on example, only one upper opening/closing motor 17 is provided inside the partition member 18, and upper pinions 171 on both sides may be connected by a shaft to be rotated by one upper opening/closing motor 17. The upper opening/closing motor 17 may be operated by a user's manipulation input to cause the upper pinion 171 to be rotated forward and backward, and the upper pinion 171 may be moved along the upper rack 64 to cause the upper drawer 60 to be automatically opened and closed. In other examples, the upper drawer 60 may be not opened and closed in the state in which the upper drawer 60 may be restrained by the upper drawer restraint part 70.

In some examples, the opening/closing motor 17 may not be provided inside the partition member 18. Herein, only the upper pinion 171 may be positioned at both sides of the partition member 18. The pair of upper pinions 171 may be coupled to the upper rack 64 formed on the bottom surface of the upper drawer 60 and accordingly, when the upper drawer 60 is opened and closed, the upper drawer 60 may be guided so that both left and right sides thereof may be opened and closed at the same time by the same amount without the inclination.

A partition member fixing part 184 for fixing the partition member 18 to the cabinet 10 may protrude from both sides of the partition member 18. In addition, an upper restraint part mounting part 185 on which the upper drawer restraint part 70 may be mounted may be formed at the center of the partition member 18. The upper restraint device mounting part 185 may be formed on the bottom surface of the partition member 18. The partition member case 181 may protrude downward to form a space in which the upper drawer restraint part 70 may be received.

In addition, the upper restraint part mounting part (or upper restraint mount) 185 may include a rear opening **185*b* through which the upper drawer restraint part 70 may be inserted rearward, and a front opening 185*a* through which the front end of the push member 72 of the upper drawer restraint part 70 protrudes. Thus, when the upper drawer restraint part 70 is mounted on the upper restraint part mounting part 185 through the rear opening 185*b*, the push member 72 protrudes through the front opening 185*a***.

In addition, a first mounting boss 186 protruding backward may be formed at both left and right sides of the rear opening **185*b*. The first mounting boss 186 may be formed at a position corresponding to the first case mounting parts 711 on both sides of the upper drawer restraint part 70 and may be fastened with a screw 187 passing through the first case mounting part 711 to cause the upper drawer restraint part 70 to be fixedly mounted on the partition member 18**.

Figure 16:
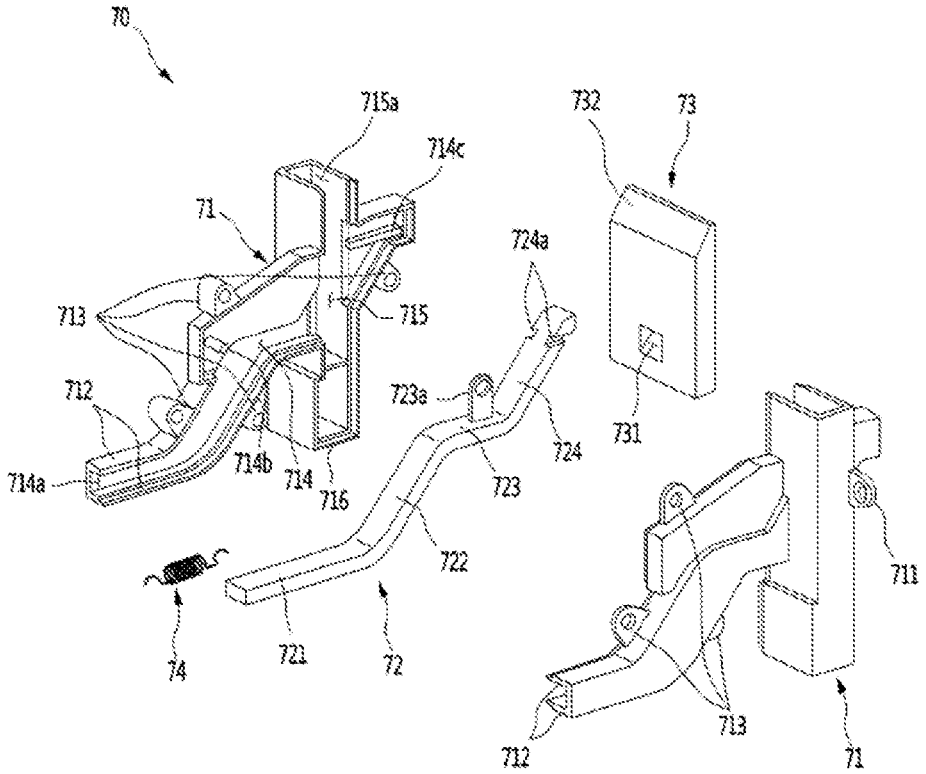
FIG. 16 may be an exploded perspective view showing a coupling structure of the upper drawer restraint part.
Figure 17:
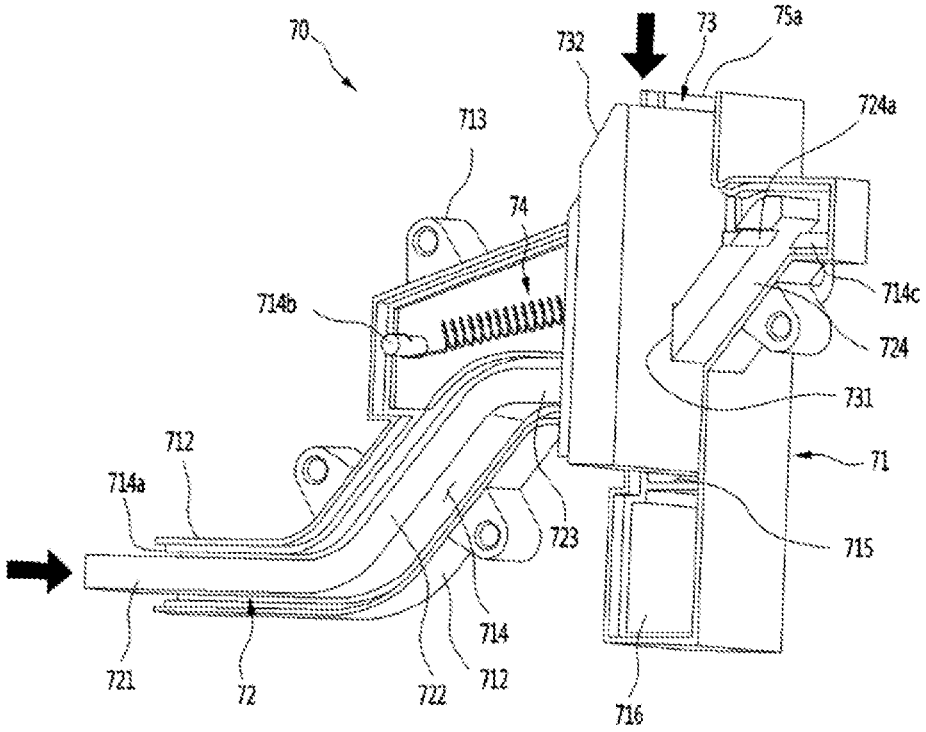
FIG. 17 may be a cutaway perspective view of the upper drawer restraint part have active to restrain the upper drawer.
Figure 18:
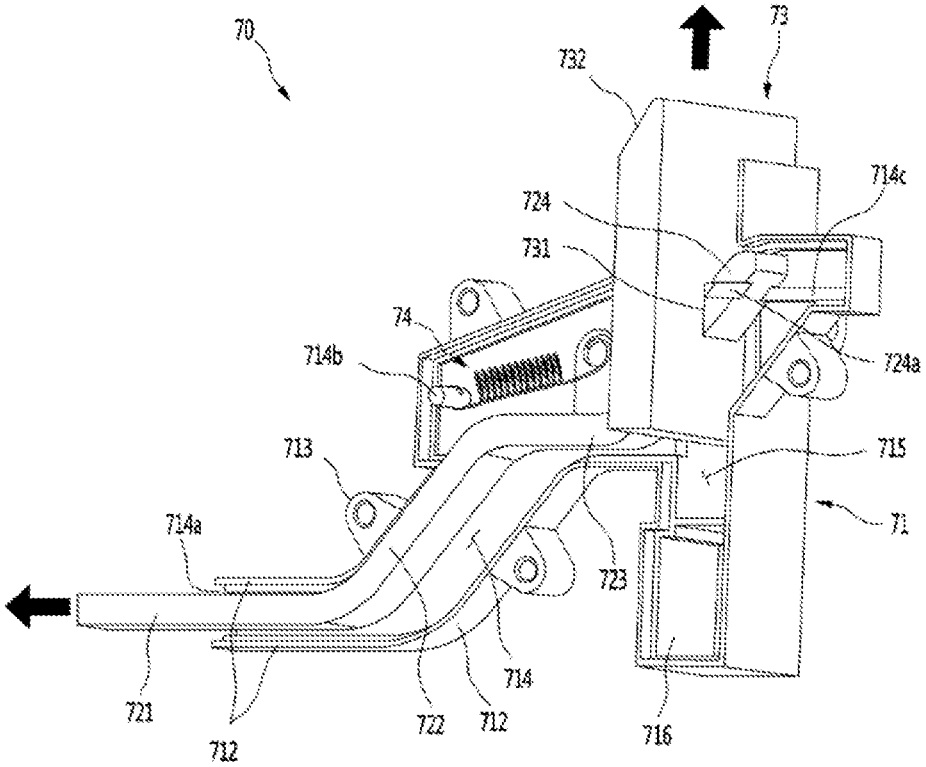
FIG. 18 may be a cutaway perspective view of the upper drawer restraint part when not restraining the upper drawer.

Hereinafter, the upper drawer restraint part 70 will be described in more detail with reference to the accompanying drawings. FIG. 16 shows an exploded perspective view showing a coupling structure of the upper drawer restraint part, FIG. 17 shows a cutaway perspective view of the upper drawer restraint part in a restrained state, and FIG. 18 shows a cutaway perspective view of the upper drawer restraint part in a non-restrained state.

As shown in the drawings, the upper drawer restraint part 70 may include a pair of upper restraint part cases 71, and a push member 72, a slider 73, and an inner elastic member 74 of the upper restraint part case 71. The pair of upper restraint part cases 71 may be provided on both left and right sides, and may be coupled to each other to form a space therein. The upper restraint part case 71 may form a space in which the push member 72 is movable in the front and rear direction, and may forms a space in which the slider 73 may be movable in the up and down direction, and in which the push member 72 and the slider 73 may be received in a movable state.

The pair of upper restraint part cases 71 have the same structure to each other on both left and right sides thereof, and an edge 712 may be formed along the outer circumference so that the pair of upper restraint part cases 71 may be coupled to form a space in which the push member 72 and the slider 73 may be positioned. In addition, a plurality of case coupling parts 713 may be formed along the edge 712. The case coupling part 713 may be formed at respective positions of the upper restraint part case 71 on both sides, and the upper restraint part cases 71 on both sides may be coupled to each other by screwing.

In addition, a push member opening 714*a* through which the end of the push member 72 enters and exits may be formed at a front end of the upper drawer restraint part 70 in a state that the upper restraint part case 71 may be coupled. A slider opening 715*a* through which the slider 73 enters and exits may be formed at an upper end of the upper drawer restraint part 70.

The space formed in the upper restraint part case 71 may include the push member receiving portion 714 and the slider receiving portion 715. The push member receiving portion 714 may be formed in a shape corresponding to the shape of the push member 72, and may be formed to extend in the front and rear direction so that the push member 72 may be received therein. The push member receiving portion 714 may be formed with an inner side having a predetermined width by a moving distance of the push member 72 so as not to interfere with the push member 72 when the push member 72 moves in the front and rear direction.

In addition, the push member receiving portion 714 may receive an upper elastic member 74 that provides an elastic force to cause the push member 72 to be returned when the push member 72 moves. The upper elastic member 74 may be formed in a coil shape, and both ends thereof may be connected to the upper restraint part case 71 and the push member 72, respectively. Therefore, the upper elastic member 74 may provide an elastic force when the push member 72 moves.

In addition, a first upper fixing portion 714*b* may be formed inside the push member receiving portion 714. The first upper fixing portion 714*b* may protrude inwardly of the push member receiving portion 714 in such a manner as to be fixed with one end of the upper elastic member 74.

In addition, a movement guide 714*c* for guiding the push member 72 to move in the front and rear direction may protrude from one side of the push member receiving portion 714. The movement guide 714*c* may be received in guide grooves 724*a* formed on both side surfaces of the push member 72 to guide the movement of the push member 72 in front and rear direction. The movement guide 714*c* may be formed in the front and rear direction in which the push member 72 may be moved, and may be formed to correspond to at least the movement distance of the push member 72 in front and rear directions.

In addition, the front end of the push member receiving portion 714 may be opened to form the push member opening 714*a*. The push member receiving portion 714 may be formed to intersect the slider receiving portion 715. The slider receiving portion 715 may be formed at a position corresponding to the inclined portion of the push member 72 in the push member receiving portion 714. The slider receiving portion 715 may extend in the vertical direction at the second half of the push member receiving portion 714, and may be positioned to intersect the push member receiving portion 714.

The slider receiving portion 715 may be formed so that the slider 73 may be completely received. The lower end of the slider receiving portion 715 may be configured to support the bottom surface of the slider 73 when the slider 73 may be completely moved downward. An upper end of the slider receiving portion 715 may form an upper end of the upper restraint part case 71, and the slider opening 715*a* may be formed at an upper end of the slider receiving portion 715.

When the slider 73 may be located at the lowermost position, the slider receiving portion 715 may extend upward so that the upper end of the slider 73 may be not exposed through an upper end of the slider receiving portion 715, for example, the slider opening 715*a*. In addition, when the slider 73 may be moved upward by the movement of the push member 72, an upper end of the slider 73 may pass through the slider opening 715*a* and protrude outwards.

Below the slider receiving portion 715, a restraint device insert portion 716 extending farther downward in the extending direction of the slider receiving portion 715 may be further formed. The restraint device insert portion 716 may be inserted in the upper restraint part mounting part 185 to cause the upper drawer restraint part 70 to be maintained. In addition, the restraint device insert portion 716 and the slider receiving portion 715 may have a larger width in left and right direction than the push member receiving portion 714 and may be configured to completely shield the rear opening 185*b* of the upper restraint device mounting part 185 from the rear.

In some examples, the push member 72 may be formed in a size and shape capable of being received in the push member receiving portion 714, and the push member 72 may enter and exit through the push member opening 714*a* to be in contact the lower drawer 30. Then, the slide member may be slidably moved in the front and rear direction inside the push member receiving portion 714 according to the contact state with the lower drawer 30.

The push member 72 may be configured with horizontal portions 721 and 723 which may be in contact with the lower drawer 30 while being generally moved in the front and rear direction and inclined portions 722 and 724 extending inclined with respect to the horizontal portions 721 and 723 to vertically move the slider 73. Multiple horizontal portions 721 and 723 and multiple inclined portions 722 and 724 may be configured as necessary, which may be suitable for the contact with the lower drawer 30 and the lifting of the slider 73.

In some examples, the horizontal portions may include a first horizontal portion 721 and a second horizontal portion 723, and the inclined portions may include a first inclined portion 722 and a second inclined portion 724. For example, the first horizontal portions 721 may form a front end of the push member 72, and the front horizontal portion 721*a* may be configured to cause the front end thereof to enter and exit through the push member opening 714*a*. In addition, the first horizontal portions 721 may be positioned to perpendicularly intersect the slider 73.

The first inclined portion 722 may be extended to be inclined at the rear end of the first horizontal portion 721 and may be extended to have a predetermined inclination toward the top and the rear. The first inclined portion 722 may be located between the first horizontal portions 721 and the second horizontal portions 723, and the placement position of the slider 73 may be determined by the length of the first inclined portion 722.

A second horizontal portion 723 may be formed at a rear end of the first inclined portion 722. The second horizontal portion 723 may extend rearwards, and extend a predetermined length in such a manner as to be positioned at a point where the second inclined portion 724 intersects the slider receiving portion 715. The second horizontal portions 723 may be formed in parallel with the first horizontal portions 721.

In addition, the second horizontal portion 723 may have a second upper fixing portion 723*a* in which an end of the upper elastic member 74 may be fixed. The second upper fixing portion 723*a* may extend upward from one side of the second horizontal portions 723 to fix an end portion of the upper elastic member 74. Therefore, the upper elastic member 74 may be fixed by the first upper fixing portion 714*b* and the second upper fixing portion 723*a*. The upper elastic member 74 may be tensioned when the push member 72 may be moved rearward and, thus, in the state as shown in FIG. 18. When the external force may be removed, the push member 72 may be moved forward to return to the initial state by the elastic force of the upper elastic member 74, as shown in FIG. 17.

The second inclined portions 724 may extend rearwards and upwards at a rear end of the second horizontal portions 724. The second inclined portions 724 may pass through the slider 73 and thus may be extended up to the rear end of the push member receiving portion 714. Accordingly, the slider 73 may be moved in the vertical direction according to the movement of the push member 72 in the front-rear direction.

A guide grooves may be further formed on both side surfaces of the second inclined portions 724 corresponding to the movement guide 714*c*. The guide groove 724*a* may have the movement guide 714*c* inserted therein when the push member 72 may be mounted. Therefore, the movement guide 714*c* may guide the push member 72 to move in the horizontal direction when the push member 72 may be moved in the front and rear direction.

In some examples, the first inclined portion 722 and the second inclined portion 724 may be moved together when the push member 72 may be moved in the front and rear direction. Accordingly, the portion of the upper restraint part case 71 corresponding to the first inclined portion 722 and the second inclined portion 724 may be formed to have a thickness thicker than the thickness of the first inclined portion 722 and the second inclined portion 724, and may have a width enough to cause the first inclined portion 722 and the second inclined portion 724 not to interfere with each other even when moved.

When the slider 73 is received inside the slider receiving portion 715 and mounted, the push member 72 may be formed to pass through the slider 73. The slider 73 may have a larger horizontal width than the push member 72 and may have a through hole 731 formed at a lower center thereof. In addition, the slider 73 may be formed in a shape corresponding to the width and thickness of the slider receiving portion 715 so that the slider 73 may be moved only vertically in a state that may be received in the slider receiving portion 715.

The through hole 731 may be formed to cause the second inclined portions 724 of the push member 72 to pass therethrough, and top and bottom surfaces of the through hole 731 may have the inclination corresponding to the second inclined portions 724. Accordingly, when the push member 72 moves in the front and rear direction in a state that the second inclined portions 724 pass through the slider 73, the slider 73 received inside the slider receiving portion 715 may be moved vertically along the inclined surface of the second inclined portions 724.

The upper end of the slider 73 may protrude above the slider opening 715*a* to be located at the highest position, in the state in which the push member 72 may be completely moved rearward. In addition, when the slider 73 may be positioned at the highest position, the end of the slider 73 may be coupled to the door restraint portion 65. An inclined surface 732 may be formed at an upper end of the slider 73.

The upper end of the slider 73 may be formed to be higher from the front to the rear by the inclined surface 732. Accordingly, when the upper end of the slider 73 protrudes above the slider opening 715*a* while the upper drawer 60 is opened, the door restraint portion 65 may be in contact with the inclined surface 732 to move the slider 73 downward, thereby preventing the drawer restraint device 70 from being damaged.

Figure 19:
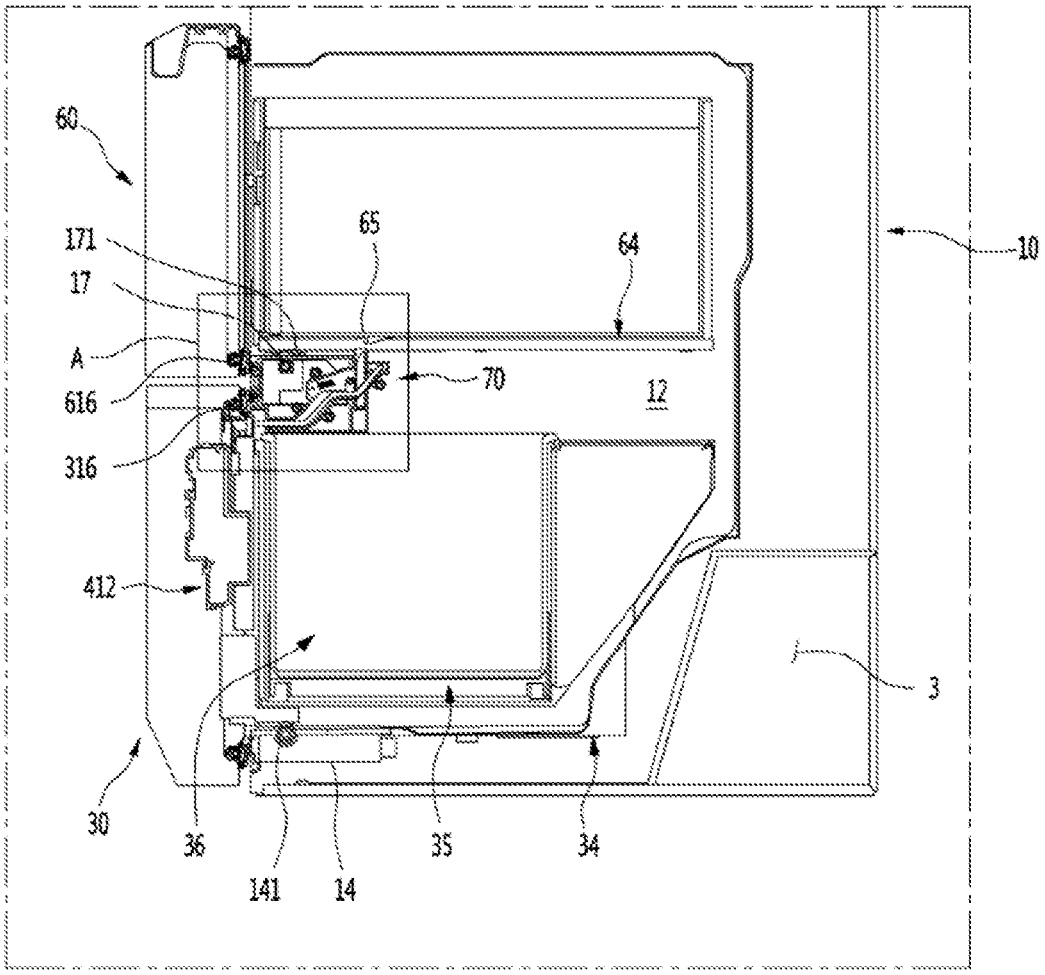
FIG. 19 may be a view showing the drawer when closed.
Figure 20:
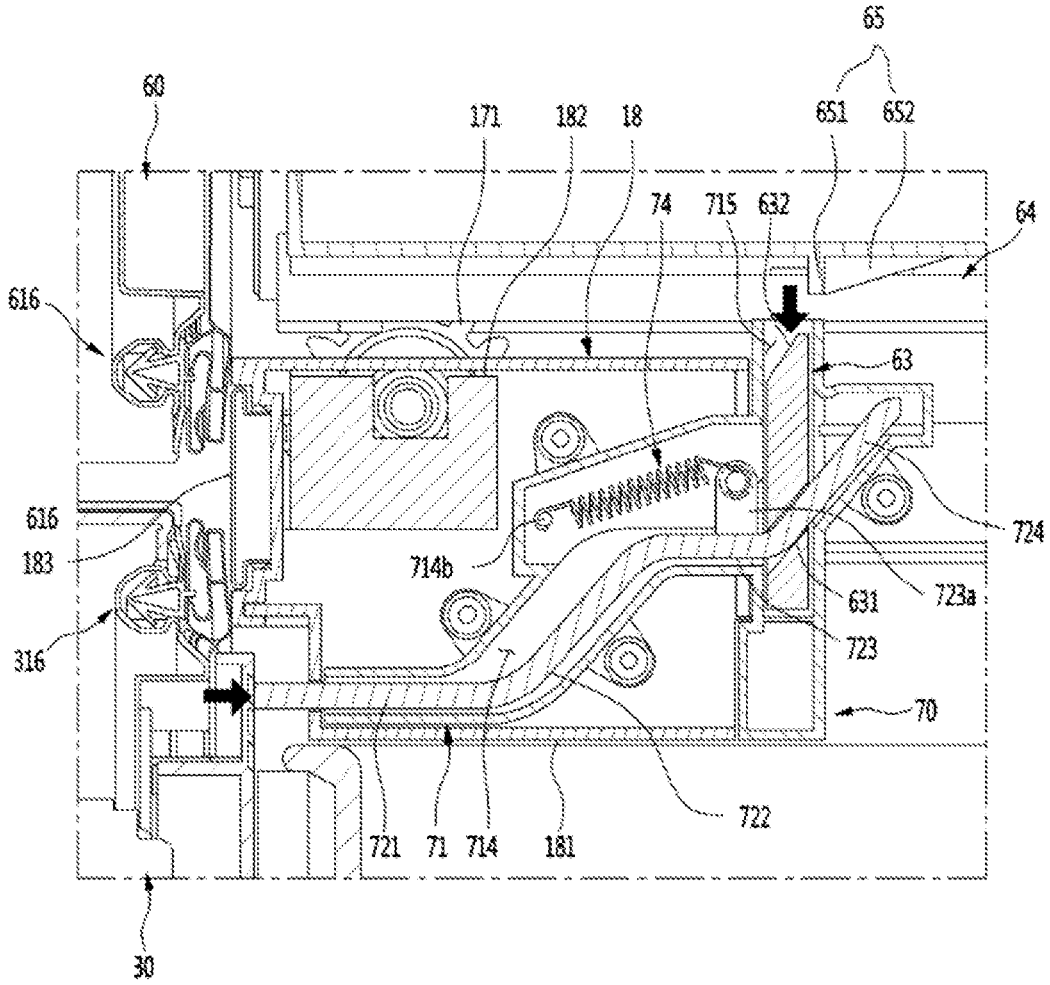
FIG. 20 may be an enlarged view showing a portion A of the closed drawer shown FIG. 19.

Hereinafter, the restraint and release states of the upper drawer 60 according to the opening/closing of the lower drawer 30 of the refrigerator 1 having the structure as described above will be described. FIG. 19 shows a view showing a state in which the drawer is closed, and FIG. 20 shows an enlarged view showing a portion A of FIG. 19. As shown in the drawings, when both the upper drawer 60 and the lower drawer 30 may be closed, the upper drawer 60 and the lower drawer 30 may shield the lower storage space 12 in the cabinet 10.

In this positioning, the lower drawer 30 maintains an airtight state by bringing the gasket 316 into close contact with the front surface of the partition member 18. In addition, the rear surface of the front panel 31 of the lower drawer 30 may maintain contact with the upper drawer restraint part 70, which may result in the push member 72 being pressed. For example, the push member 72 may be located at the rearmost position inside the upper restraint part case 71, and the upper elastic member 74 may be in a state of being stretched to the maximum length. The slider 73 may be positioned below the second inclined portions 724 and may be positioned at the lowest position inside the slider receiving portion 715.

Accordingly, the upper end of the slider 73 may be not in contact with the door restraint portion 65 at the top surface of the upper drawer 60 and may be located at a lower position than the lower end of the door restraint portion 65 so as not to interfere with the opening/closing of the upper drawer 60. In such a state, the upper drawer 60 may be opened forward by the user's manipulation, and may be closed back after the opening. In other examples, the upper opening/closing motor 17 may be operated by a user's manipulation, so that the upper pinion 171 may be moved along the upper rack 64 so that the upper drawer 60 may be automatically opened and closed.

In some examples, the opening/closing motor 14 may be also operated by the user's manipulation so that the pinion 141 moves along the rack 34, thereby allowing the lower drawer 30 to be automatically opened and closed. In addition, the lower drawer 30 may operate the lift motor 411 in an open state to lift the lifting member 35. For example, the upper drawer 60 and the lower drawer 30 may be freely opened/closed and raised by the user's manipulation.

Figure 21:
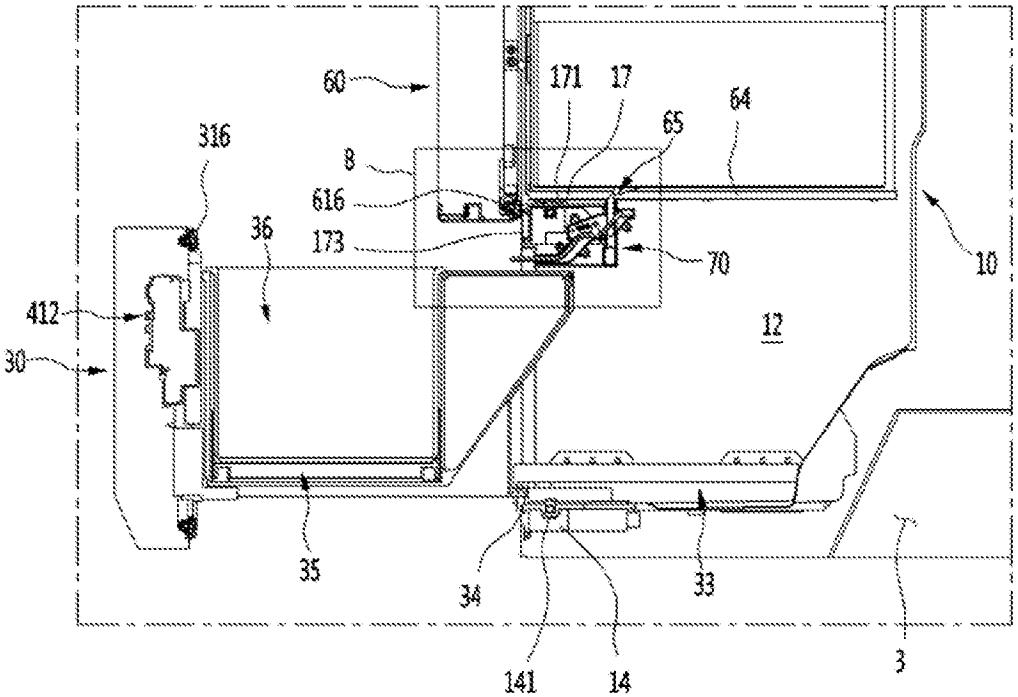
FIG. 21 may be an exemplary view showing a drawer when opened.
Figure 22:
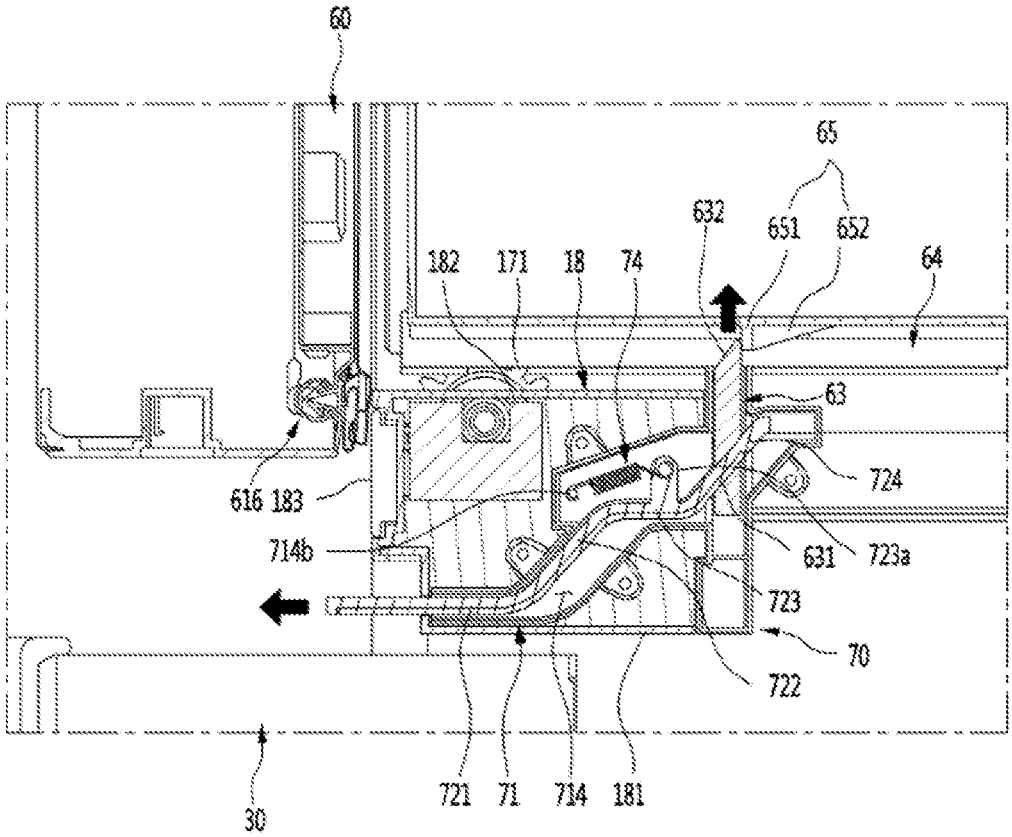
FIG. 22 may be an enlarged view of portion B of the opened drawer shown in FIG. 21.

FIG. 21 shows an exemplary view showing an opened state of the drawer, and FIG. 22 shows an enlarged view of portion B of FIG. 21. As shown in the drawings, the lower drawer 30 may be opened by a user's manipulation. The opening/closing motor 14 may be operated according to a user's manipulation input, and the lower drawer 30 may be opened forward.

When the lower drawer 30 moves to be opened by a predetermined distance, the lift motor 411 may be operated, and power may be transmitted through the door side device 41 and the drawer side device 50 so that the rail assembly 50 may cause the lifting member 35 to be raised. In some examples, the lower drawer 30 may be opened at the same time to be moved forward, and accordingly, the front panel 31 of the lower drawer 30 may be separated from the push member 72. When the force of the lower drawer 30 that has pressed the push member 72 is removed, the push member 72 may be moved forward by the elastic force of the upper elastic member 74. In addition, when the push member 72 moves forward, the push member 72 may be guided to move forward by the guide groove 724*a* and the movement guide 714*c* of the push member 72.

As the push member 72 moves forward, the slider 73 through which the second inclined portions 724 passes may be moved upward. The slider 73 may be received in the slider receiving portion 715 so as to be movable only in the vertical direction. When the second inclined portions 724 are moved forward, the inclined inner upper and lower surfaces of the through hole 731 may move along the inclination of the second inclined portions 724. Accordingly, the slider 73 may move upward, and the upper end of the slider 73 may protrude upward through the slider opening 715*a*. The protruding upper end of the slider 73 may be locked to the front surface of the door restraint portion 65 in front of the door restraint portion 65 as shown in FIG. 22, thereby restraining forward movement of the upper drawer 60.

In some examples, the push member 72 may be moved forward by the upper elastic member 74 while the lower drawer 30 moved to be opened, and the slider 73 may be also moved upward and then locked to the door restraint portion 65 while the push member 72 is being moved. For example, since the upper drawer 60 may be restrained at the same time that the lower drawer 30 is opened forward, when the lower drawer 30 starts to be opened, the upper drawer 60 may not be opened forward. However, the closing rearward may be possible. Therefore, since the lower drawer 30 may be opened forward and then raised, the lower drawer 30 may be prevented from colliding or interfering with the upper drawer 60, in when the lower drawer 30 is opened and raised.

In some examples, as described above, the installation position of the door restraint portion 65 may be changed. Depending on the position where the door restraint portion 65 is installed, the lower drawer 30 may be restrained to not be opened when closed, or the lower drawer 30 may be restrained to not be opened further when opened by a predetermined distance.

Figure 23:
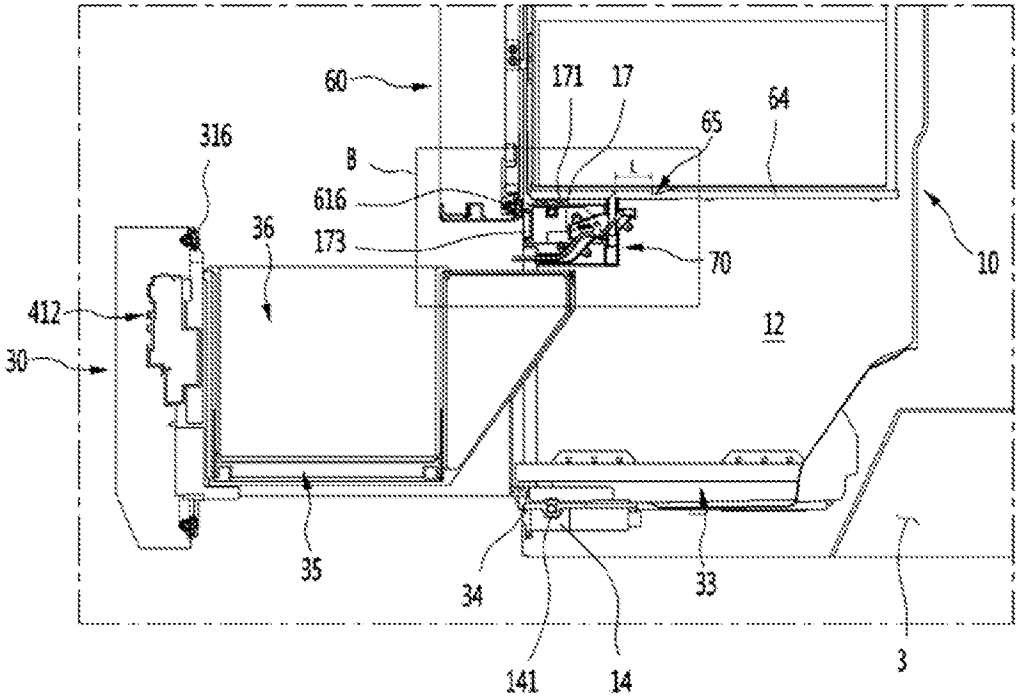
FIG. 23 may be another exemplary view showing a drawer when opened.
Figure 24:
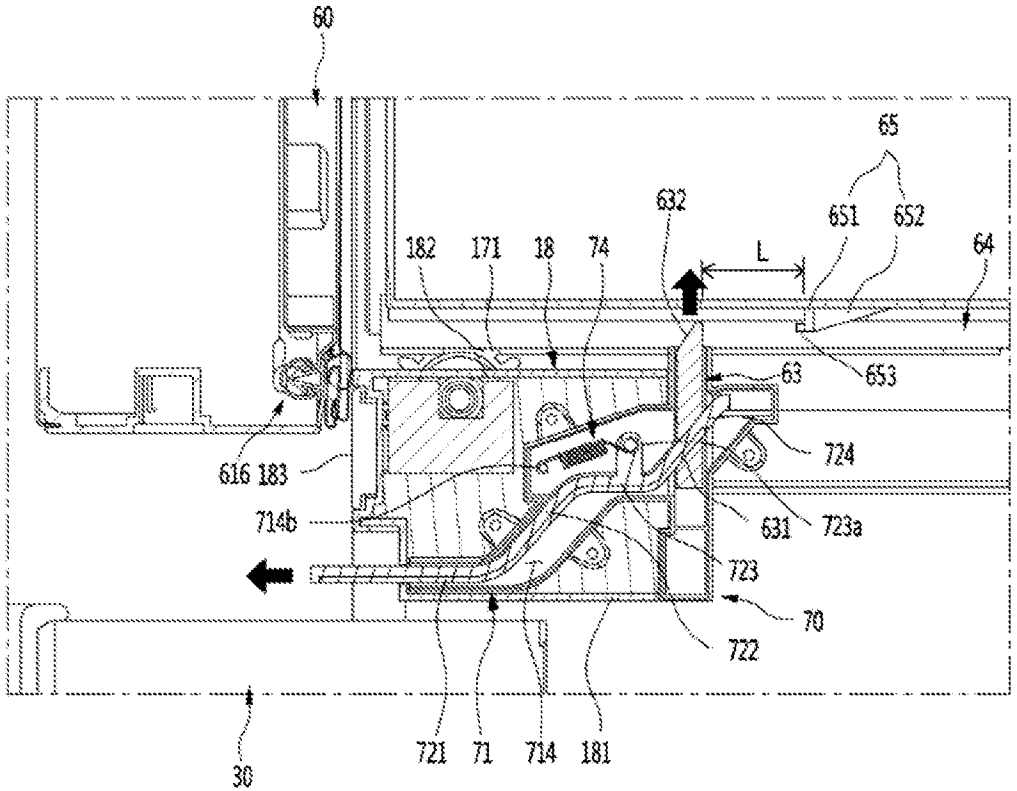
FIG. 24 may be an enlarged view of a portion B of the opened drawn shown FIG. 23.

FIG. 23 show another exemplary view showing an opened state of the drawer, and FIG. 24 show an enlarged view of a portion B of FIG. 23. FIGS. 23 and 24 primarily differ from FIGS. 21 and 22 in that the position of the door restraint portion 65 is changed. For example, FIG. 23 and FIG. 24 show an example in which the door restraint portion 65 is moved to be installed rearward by a predetermined distance L. The operation of the upper drawer restraint part 70 may be the same as in FIGS. 21 and 22. For example, the push member 72 may be moved forward by the upper elastic member 74 at the same time as the lower drawer 30 may be closed, and the slider 73 may be also upwardly moved simultaneously with the movement of the push member 72.

Herein, since the door restraint portion 65 is moved rearward by the distance L, the upper drawer 60 may be not immediately restrained, but may be opened by the predetermined distance L when the upper drawer 60 remains closed while the lower drawer 30 is being opened forward.

When the upper drawer 60 opens by the predetermined distance L, the upwardly moved slider 73 may be locked to the door restraint portion 65, to cause the upper drawer 60 to be locked. Therefore, when the upper drawer 60 may be opened after the lower drawer 30 may be opened, the upper drawer 60 may be opened and then restrained at the predetermined distance L, whereby opening may be no longer allowed. However, closing rearward may be possible.

Herein, when the lower drawer 30 may be opened forward and the raised, the predetermined distance L may be determined in consideration of the distance between the rear surface of the raised lower drawer 30 and the front surface of the upper drawer 60. For example, when the upper drawer 60 moves to be opened by the predetermined distance L while the lower drawer 30 raises, the predetermined distance L may be determined so that the front surface of the opened upper drawer 60 does not collide with the rear surface of the raised lower drawer 30. For example, the predetermined distance L may be shorter than the distance between the front surface of the opened upper drawer 60 and the rear surface of the raised lower drawer 30.

Therefore, since the lower drawer 30 may be opened forward and then raised, the lower drawer 30 may be prevented from colliding or interfering with the upper drawer 60 when the lower drawer 30 is being raised or completes being raised. In addition, when the upper drawer 60 is restrained at the predetermined distance L, the upper drawer 60 may be closed after a predetermined time may have elapsed. In addition, when the upper drawer 60 may be restrained at the predetermined distance L, such that the lower drawer 30 may be automatically lowered and then closed.

In addition, the opening distance of the upper drawer 60 may be detected by the open/close detecting part 15. In some examples, the door restraint portion 65 may further include a push switch 653. The push switch 653 may be installed on the front surface of the restraint rib 651. Therefore, when the upper drawer 60 is opened by the predetermined distance L, the slider 63 presses the push switch 653. Accordingly, the push switch 653 inputs a restraint signal of the upper drawer 60 to a controller 90, to be described later. When a push signal is input from the push switch 653, the controller 90 may inform the outside through a display 21 or a speaker 92 that the upper drawer 60 is opened, and may drive the opening/closing motor 14 to cause the lower drawer 30 to be automatically closed. The user may check the output information to recognize that the upper drawer 60 is opened.

In addition, when outputting that the upper drawer 60 is to be opened, the user may close the upper drawer 60 by manually pushing the same.

Figure 25:
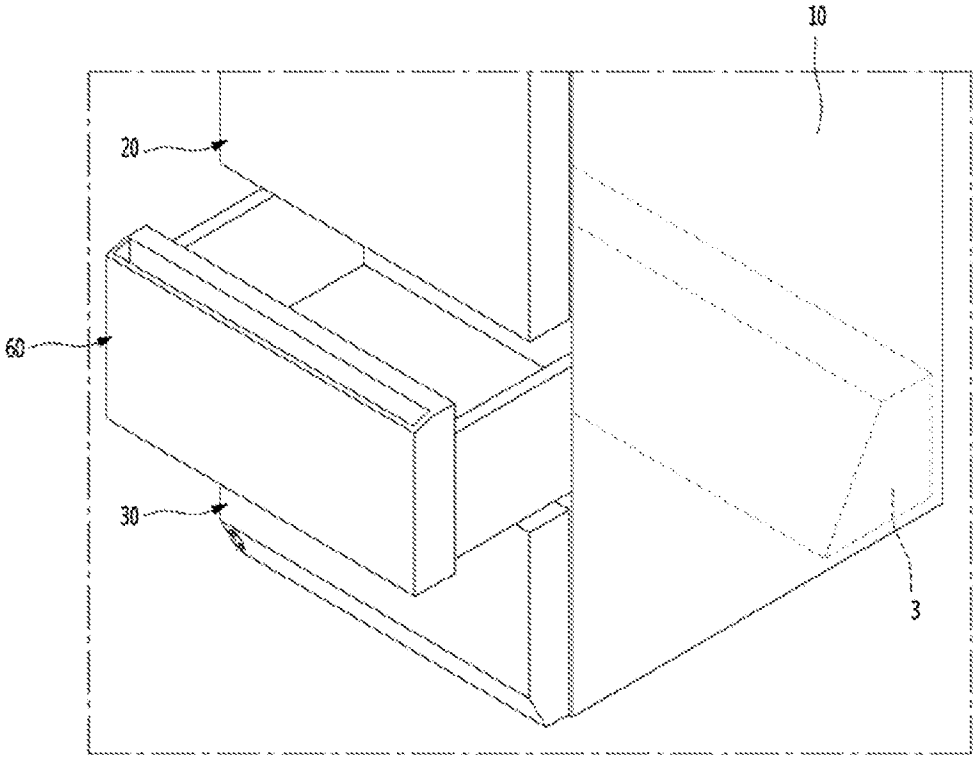
FIG. 25 may be a perspective view of a lower drawer when opened.

FIG. 25 shows a perspective view of a state in which the lower drawer is opened. As shown, when a user wants to store food in the upper drawer 60, he/she may open/close the upper drawer 60. The user may open the upper drawer 60 by pulling out the upper drawer 60 with holding the handle recessed at the upper end of the upper drawer 60.

In some examples, the lower drawer 30 may be in a closed state while the upper drawer 60 is opened. When the upper drawer 60 is opened and the lower drawer 30 is also opened, the center of gravity of the refrigerator 1 may move forward so that the refrigerator 1 may fall forward. For example, when heavy food may be stored in the upper drawer 60 and the lower drawer 30, the refrigerator 1 may be more likely to fall forward. Therefore, when the lower drawer 30 is opened when the upper drawer 60 is also opened, the lower drawer 30 may be immediately closed and then restrained. For example, when the opening of the lower drawer 30 is detected when the upper drawer 60 is opened, the lower drawer 30 may be immediately closed.

Herein, when the closing of the lower drawer 30 is completed, the opening/closing motor 14 may be braked so as not to be rotated any more. In other examples, while the upper drawer 60 is being opened, it may be also possible to restrain the upper drawer 60 from the beginning so that the upper drawer 60 remains the closing state. To this end, the opening/closing motor 14 may include a motor (commonly called a braking motor, a brake motor) provided with a brake capable of optionally restraining the motor.

For example, when the lower drawer 30 is opened while the upper drawer 60 is open, there may be a risk of the falling forward. Therefore, the lower drawer may be closed and restrained immediately when the lower drawer 30 is opened in a state where the upper drawer 60 is opened, or the lower drawer 30 may be restrained at the same time that the upper drawer 60 is opened.

Accordingly, when any one of the upper drawer 60 and the lower drawer 30 is opened, the other may be opened to some extent but not permitted to be fully opened. For example, both the upper drawer 60 and the lower drawer 30 would not be simultaneously fully opened to prevent the situation in which the refrigerator 1 falls forward.

Figure 26:
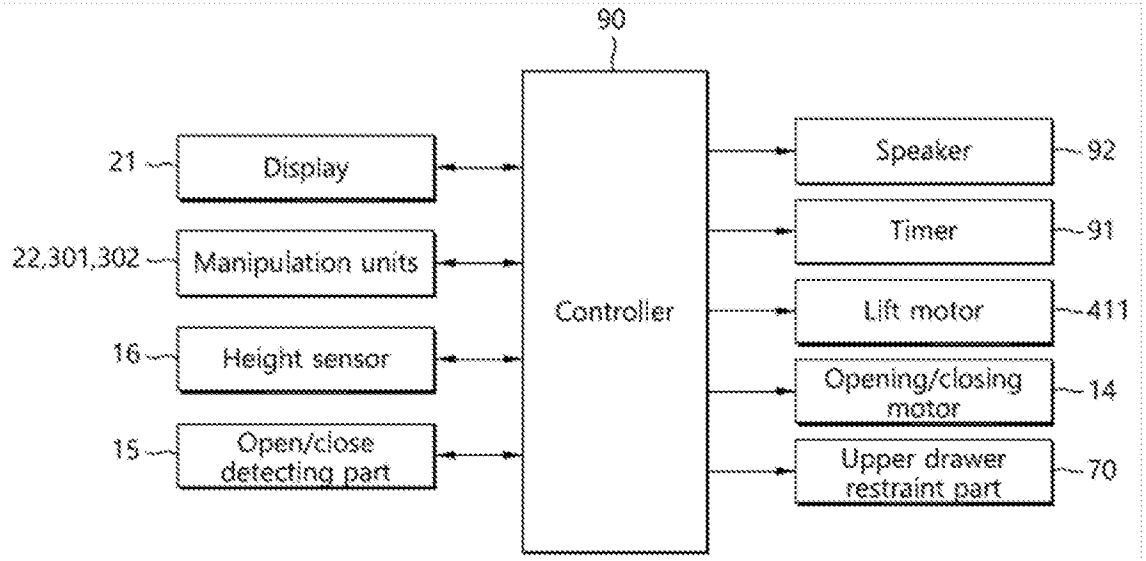
FIG. 26 may be a block diagram schematically showing a connection of a controller of the refrigerator and components connected to the controller.
Figure 27:
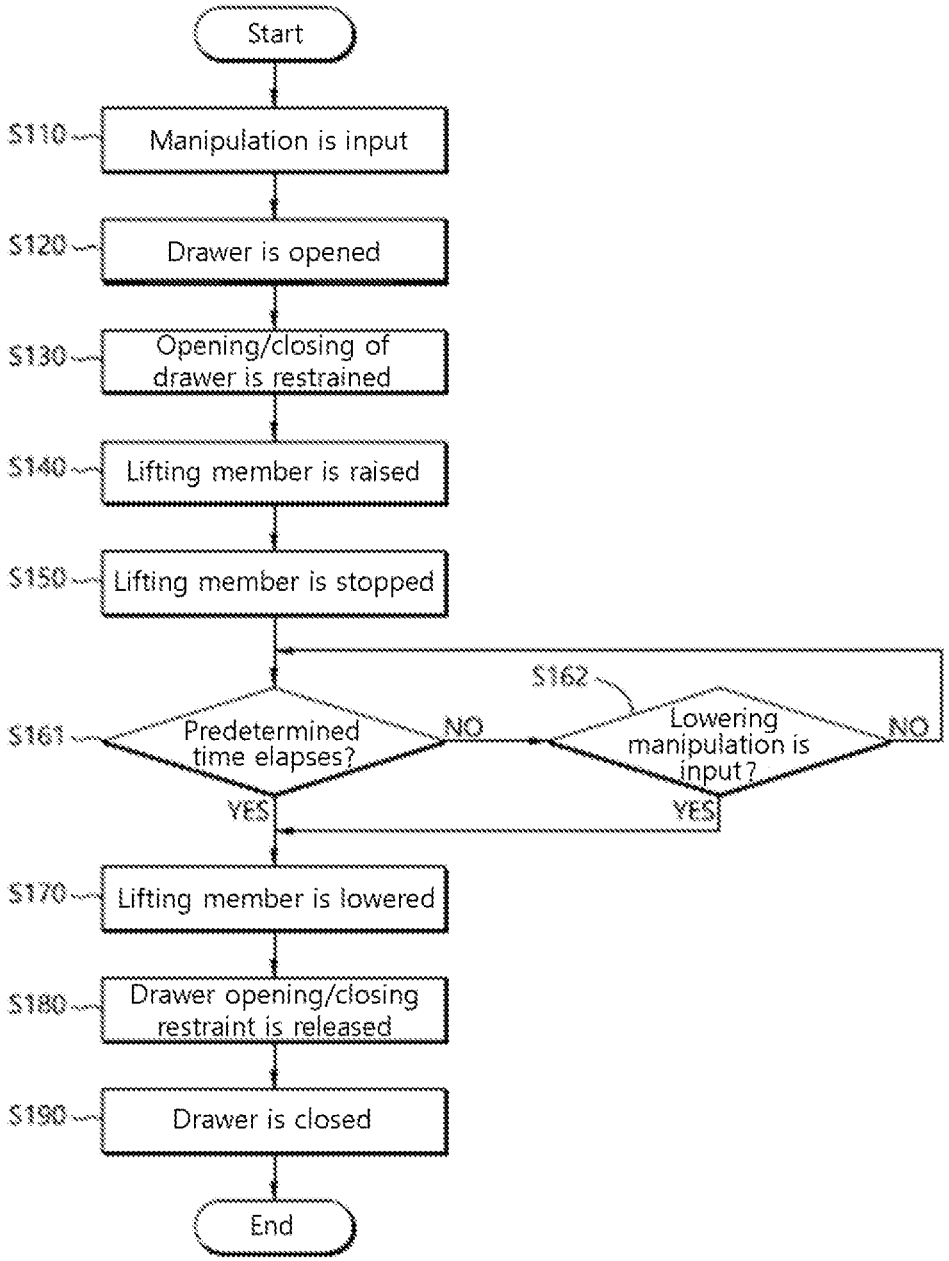
FIG. 27 may be a flowchart illustrating opening/closing and lifting operations of the drawer.

FIG. 26 is a block diagram schematically showing a connection of a controller and components connected to the controller of the refrigerator according to an embodiment of the present disclosure, and FIG. 27 is a flowchart illustrating opening/closing and lifting operations of the drawer. The controller 90 may be applied to the upper drawer 60 and the lower drawer 30 in the same manner and may perform the same operation. In addition, communication between the controllers 90 of the upper drawer 60 and the lower drawer 30 may be possible. In other examples, one controller 90 may control both of the upper drawer 60 and the lower drawer 30.

Referring to these drawings, the refrigerator 1 keeps both the swinging door 20 and the drawer 2 closed in a food storage state. In this state, the user may open the drawer 2 to store food. Multiple drawers 2 may be provided in an upper portion and a lower portion of a refrigerator. For example, the upper drawer 60 may be provided in the upper portion, and the lower drawer 30 may be provided in the lower portion, while being arranged to be adjacent to each other.

In order to perform opening/closing of the drawer 2, a user may input an opening/closing manipulation through the manipulation units 22, 301, and 302. When the manipulation of any one of the manipulation units 214, 301, 302 may be not input, the drawer 2 may be not opened [S110: manipulation input step].

When the controller 90 that controls the overall operation of the refrigerator 1 determines that the manipulation input may be valid in the manipulation input step, the controller 90 controls the opening/closing motor 14 so that the operation of the opening/closing motor 14 starts. When the opening/closing motor 14 is operated by the instruction of the controller 90, the drawer 2 may be opened forward. The opening/closing distance of the drawer 2 may be determined by the open/close detecting part 15. When the open/close detecting part 15 detects that the drawer 2 may be opened up to a predetermined distance, the controller 90 may determine that the opening of the drawer 2 may be completed. The driving of the opening/closing motor 14 may be stopped to complete the opening of the drawer 2 [S120: drawer opening step].

Herein, when the drawer 2 moves to be opened, the opening/closing motor 14 may be braked so as not to be rotated any more. For example, while the lifting member 35 inside the drawer 2 may be operated, the drawer 2 may be maintained in the opening state. To this end, the opening/closing motor 14 may be embodied by a motor (commonly called a braking motor or a brake motor) provided with a brake capable of optionally restraining the motor [S130: Door opening/closing restraint step].

In some examples, the lifting member 35 may be maintained at the maximum lowering position until the drawer 2 moves to be completely opened. When the height sensor 16 determines that the lifting member 35 may be at the maximum lowering position, the lifting member 35 may start the operation upon the user's manipulation or complete opening of the drawer 2. When the drawer 2 opens by a predetermined distance, the controller 90 instructs the operation of the lift motor 411, and the lifting member 35 may be raised by the lift motor 411.

The lift motor 14 may be operated by the controller 90 when the drawer 2 moves to be completely opened, and the opening/closing motor 14 may be stopped. The lifting member 35 may be configured to operate only when the drawer 2 moves to be opened enough to ensure safe lifting of the food or container 36 seated on the lifting member 35. In addition, in order to protect the safety of the user and the stored food from being damaged, the lifting member 35 may be configured to start the operation when the predetermined time elapses after the opening of the drawer 2.

The lifting member 35 stops moving when the lifting member 35 moved to be raised to a height enough to facilitate access to the food or container 36 seated on the lifting member 35. In this state, the user may easily pick up the food or container 36 without excessively bending forward [S140: lifting member raising step].

When the lifting member 35 completes being raised, the maximum raising position may be detected by the height sensing device 16. When the height sensor 16 determines that the lifting member 34 may be in a completely raised state, the lift motor 411 may be stopped. In this state, the lifting member 35 may be located inside the drawer 2, but the food or container 36 seated on the lifting member 35 may be positioned higher than the opened top surface of the drawer portion 32, thereby allowing the user to easily access the same. For example, to pick up the container 36, the user does not have to be excessively bend forward so that safer and more convenient operation may be possible [S150: lifting member stopping step].

When the lifting member 35 reaches the predetermined height, the lift motor 411 may be stopped and the timer 91 counts the stop time of the lift motor 411. For example, the lifting member 35 waits for a predetermined time when that the raising of the lifting member 35 is completed.

The controller 90 determines whether the time counted by the timer 91 reaches a predetermined time. When it may be determined by the controller 90 that the predetermined time has elapsed after the lifting member 35 may be stopped, the lift motor 411 starts the reverse rotation and thus the lifting member 35 may be lowered. Herein, the predetermined time may be set, for example, to about 90 seconds. The predetermined time may be set to a time sufficient for a user to store the food. When the predetermined time is too short, the lifting member 35 may be lowered before completing the storage of food, which may cause inconvenience of use. When the predetermined time is too long, the drawer 2 may be exposed for a long time, which may cause an excessive loss of cold air, whereby there may occur a problem of lowering cooling performance and increasing power consumption. Therefore, the predetermined period may be set to approximately 90 seconds.

The opening, closing, raising, and lowering operations of the drawer 2 may be set by the user through the manipulation input of the display 21 and may be adjusted to a desired time desired by the user. In addition, when the lifting member 35 is stopped and in a waiting state, the elapsed time of the predetermined time may be output on a screen through the display 21 or output to the outside through the speaker 92. Therefore, the user may recognize the change in the predetermined time and perform the food storing operation, and may determine when the drawer 2 is closed [S161: Predetermined time elapse determination step].

In some examples, when the user wants to close the drawer 2 because he/she completes the food storage operation before the predetermined time has elapsed, the user may input the lowering manipulation of the lifting member 35 by manipulating one of the manipulation units 214, 301, and 302. In addition, the user may determine the remaining time until the drawer 2 is closed through the screen output from the display 211 or the voice output from the speaker 92, and correspondingly determine the speed of food storage operation. Further, even when a large length of time is remaining until the drawer 2 is closed, the lowering of the lifting member 35 and the closing of the drawer 2 may occur by manipulating any one of the manipulation units 214, 301, and 302. For example, the user manipulates any one of the manipulation units 22, 301, 302 to lower the lifting member 35 and close the drawer 2 before a predetermined time elapses when the lifting member 35 may be raised [S162: lowering manipulation input step].

When the predetermined time elapses or when the lowering manipulation may be input, the controller 90 instructs the operation of the lift motor 411, and the lifting member 35 starts lowering. The lowering of the lifting member 35 may be performed by the reverse rotation of the lift motor 64, and may be gradually performed through the reverse process to the raising of the lifting member 35 described above.

Then, when the lowering of the lifting member 35 may be completed, the height sensor 16 detects the completion of the lowering of the lifting member 35. For example, when the magnet 563 may be detected by the detection sensor positioned below, the controller 90 determines that the lowering of the lifting member 35 may be completed and stops the driving of the lift motor 411 [S170: lifting member lowering step].

When the controller 90 receives the lowering completion signal of the lifting member 35, the controller 90 releases the restraint of the opening/closing motor 14 at the same time. The controller 90 may release the braking of the opening/closing motor 14 or release the restraint of the drawer 2 to allow the drawer 2 to be opened/closed.

For example, the controller 90 completely restrains the opening/closing of the drawer 2 until the lowering of the lifting member 35 may be completed, so that the lifting member 35 may be stably performed and at the same time the storage operation of the food may also be performed easily and safely [S180: Door opening/closing restraint releasing step].

When the braking of the opening/closing motor 14 may be released, the controller 90 instructs the opening/closing motor 14 to rotate in a reverse direction. The drawer 2 may be closed by the reverse rotation of the opening/closing motor 14 [S190: drawer closing step].

The opening/closing motor 14 may be rotated in a reverse direction until the drawer 2 may be completely closed. When the drawer 2 may be completely closed, the open/close detecting part 15 may detect the close completion of the drawer 2. When the drawer 2 may be closed, the drawer 2 maintains a standby state so that the drawer 2 may be opened again. In addition, the controller 90 maintains a standby state until a user's manipulation may be input and controls devices configuring the refrigeration cycle to perform an operation for cooling the inside of the refrigerator.

Herein, when the opening of the upper drawer 60 was detected by the open/close detecting part 15 of the upper drawer 60 when the lifting member 35 moves to be raised or is at the maximum raised position, the opening/closing motor 14 of the upper drawer 60 may be operated to cause the upper drawer 60 to be closed. In addition, when the opening of the upper drawer 60 may be detected by the open/close detecting part 15 of the upper drawer 60 in a state that the lifting member 35 may be being lowered or at the maximum lowered position, the opening/closing motor 14 of the upper drawer 60 may be operated to cause the upper drawer 60 to be closed.

Hereinafter, other control methods of the refrigerator will be described for example with reference to the accompanying drawings. Among steps of the control method to be described below, the same steps as those in the above-described control method may be denoted by the same reference numerals, and a detailed description thereof will be omitted. In addition, the following control methods may be made with a combination of at least one or more steps.

Figure 28:
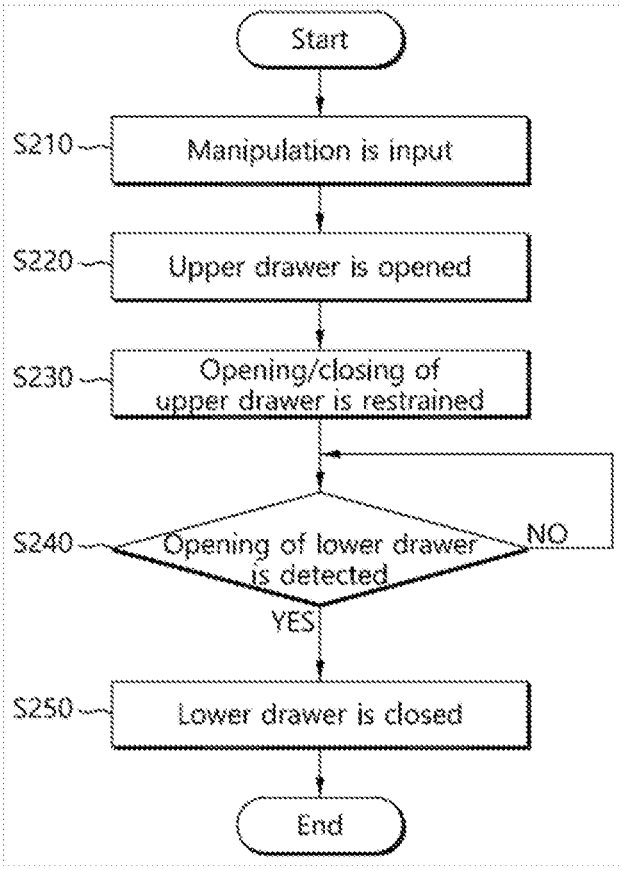
FIG. 28 may be a flowchart illustrating an operation of the lower drawer when the lower drawer may be opened when the upper drawer may be opened.

FIG. 28 shows a flowchart illustrating an operation of the lower drawer when the lower drawer may be opened when the upper drawer may be opened. Referring to FIGS. 26 and 28, for the opening/closing of the upper drawer 60, a user may input an opening/closing operation through the manipulation units 22, 301, and 302. When no manipulation may be input from the manipulation units 214, 301, 302, the upper drawer 60 may be not opened [S210: manipulation input step].

The controller 90 controlling the operation of the refrigerator 1 causes the opening/closing motor 14 of the upper drawer 60 to be operated when it may be determined that the manipulation input may be valid in the manipulation input step. When the opening/closing motor 14 may be operated by the instruction of the controller 90, the upper drawer 60 may be opened forward. The opening/closing distance of the upper drawer 60 may be determined by the open/close detecting part 15 of the upper drawer 60.

When the open/close detecting part 15 detects that the upper drawer 60 may be completely opened, the controller 90 may determine that the opening of the upper drawer 60 may be completed. When the opening of the upper drawer 60 may be completed, the driving of the opening/closing motor 14 may be stopped [S220: upper drawer opening step].

Herein, when the opening of the upper drawer 60 may be completed, the opening/closing motor 14 may be braked so as not to be rotated any more. For example, while the upper drawer 60 may be opened, the upper drawer 60 may be required to maintain the opened state so that the user may work stably. To this end, the opening/closing motor 14 may be embodied by a braking motor provided with a brake capable of optionally restraining the motor [S230: upper drawer opening/closing restraint step].

As such, the lower drawer 30 may be opened while the upper drawer 60 may be completely opened. For example, when the upper drawer 60 may be opened, the user may open the lower drawer 30 to take out the storage from the lower drawer 30. When the lower drawer 30 may be opened when the upper drawer 60 may be opened, the opening of the lower drawer 30 may be detected by the open/close detecting part 15 of the lower drawer 30 [S240: Lower drawer opening detection step].

As described above, when the lower drawer 30 may be opened when the upper drawer 60 may be opened, since the center of gravity may be moved forward so that there may be a concern of falling forward, the lower drawer 30 may be required to be closed immediately. Herein, the lower drawer 30 may be closed immediately when the opening of the lower drawer 30 may be detected. The open/close detecting part 15 may detect the opening of the lower drawer 30 immediately when the lower drawer 30 starts to be opened. The open/close detecting part 15 may transmit a detection signal to the controller 90 immediately after detecting the opening of the lower drawer 30. The controller 90 may immediately drive the opening/closing motor 14 to cause the lower drawer 30 to be immediately closed [S250: Lower drawer closing step].

As such, when the lower drawer 30 may be opened in the state in which the upper drawer 60 may be opened, the lower drawer 30 may be immediately closed, thereby preventing the two doors 60 and 30 from being opened at the same time.

Figure 29:
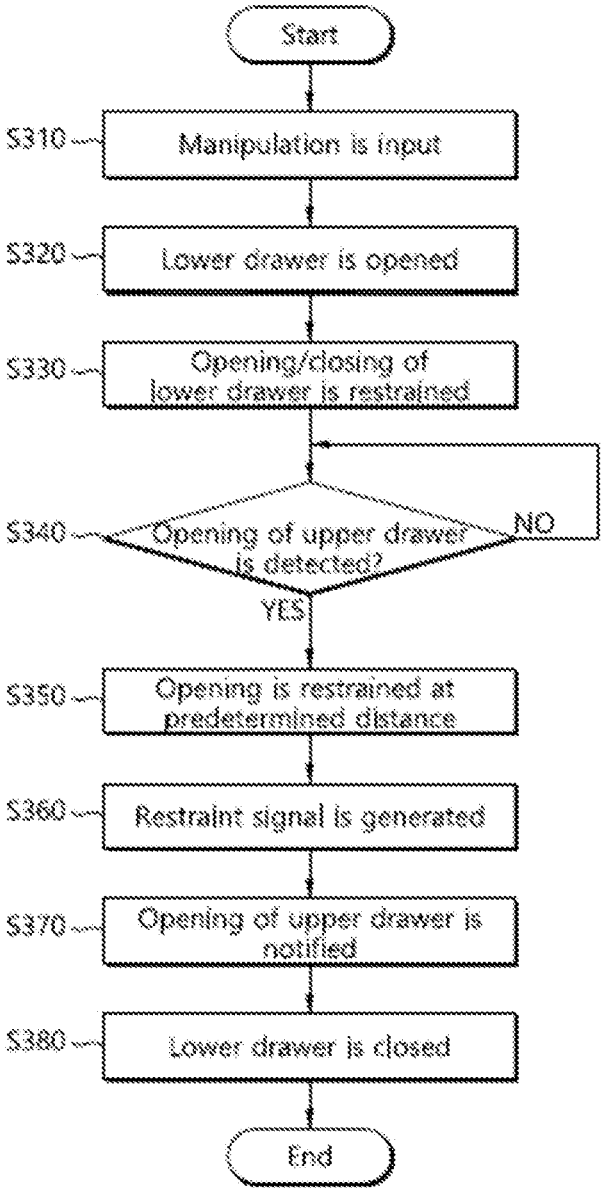
FIGS. 29 and 30 may be flowcharts illustrating the operation of the upper drawer when the upper drawer may be opened when the lower drawer may be already opened.

FIG. 29 shows a flowchart illustrating the operation of the upper drawer when the upper drawer may be opened in a state where the lower drawer may be opened. Referring to FIGS. 26 and 29, a user may input an opening/closing manipulation through the manipulation units 22, 301, and 302 for the opening/closing of the lower drawer 30. When no manipulation input is received any one of the manipulation units 214, 301, 302, the lower drawer 30 may be closed [S310: manipulation input step].

The controller 90 causes the lower drawer 30 to be operated when a manipulation input may be input in the manipulation input step. When the opening/closing motor 14 may be operated by the instruction of the controller 90, the lower drawer 30 may be opened forward. The opening/closing distance of the lower drawer 30 may be determined by the open/close detecting part 15 of the lower drawer 30.

When the open/close detecting part 15 detects that the lower drawer 30 may be completely opened, the controller 90 may determine that the opening of the lower drawer 30 may be completed. When the opening of the lower drawer 30 may be completed, the driving of the opening/closing motor 14 may be stopped [S320: Lower drawer opening step].

Herein, when the opening of the lower drawer 30 may be completed, the opening/closing motor 14 may be braked so as not to be rotated any more. For example, while the lower drawer 30 remains opened, the lower drawer 30 may be required to maintain the opened state so that the user may work stably. To this end, the opening/closing motor 14 may be a braking motor provided with a brake capable of restraining optionally the motor [S330: Lower drawer opening/closing restraint step].

As such, the upper drawer 60 may be opened when the lower drawer 30 moves be completely drawn out and opened. For example, when the lower drawer 30 has already moved to be opened, a user may open the upper drawer 60 to pick up storage from the upper drawer 60.

When the upper drawer 60 may be opened when the lower drawer 30 may be opened, the opening of the upper drawer 30 may be detected by the open/close detecting part 15 of the upper drawer 60 [S340: upper drawer opening detection step]. When the upper drawer 60 opens, the upper drawer 60 may be restrained at the predetermined distance L, and accordingly the opening of the upper drawer 60 may not proceed any further.

Such restraint of the upper drawer 60 may be achieved by the upper drawer restraint part 70. In the upper drawer restraint part 70, as the lower drawer 30 may be opened forward, the push member 72 may be moved forward by the upper elastic member 74, and the slider 73 may be also moved upward simultaneously with the movement of the push member 72.

Herein, since the door restraint portion 65 may be installed at the rear by the predetermined distance L, the upper drawer 60 may be not immediately restrained in the closed state when the lower drawer 30 opens forward, but be opened by the predetermined distance L. When the upper drawer 60 opens by the predetermined distance L, the slider 73 may be moved upward and thus locked to the door restraint portion 65, whereby the upper drawer 60 may be restrained from further opening past the distance L.

Therefore, when the upper drawer 60 opens while the lower drawer 30 opens, the upper drawer 60 may be opened and then restrained at the predetermined distance L, so that further opening would not be permitted. However, the closing rearward may be possible. Herein, the predetermined distance L may be determined in consideration of the distance between the rear surface of the raised lower drawer 30 and the front surface of the upper drawer 60 when the lower drawer 30 may be opened forward and then raised. For example, the predetermined distance L may be preferably shorter than the distance between the front surface of the opened upper drawer 60 and the rear surface of the raised lower drawer 30 [S350: Upper drawer opening restraint step].

When the upper drawer 60 was restrained as described above, the slider 73 may press a push switch 653 provided on the front surface of the restraining rib 651 of the door restraint portion 65. When the push switch 653 is pressed, a restraint signal of the upper drawer 60 may be generated, and the restraint signal may be transmitted to the controller 60 [S360: restraint signal generation step].

The controller 60 may notify the outside that the upper drawer 60 may be currently opened through the restraint signal. For example, such notification may be output on a screen via the display 21 or output as a voice via the speaker 92. Thus, the user may recognize that the upper drawer 60 may have been already opened through the screen or the speaker [S370: upper drawer opening notification step].

When the restraint of the upper drawer 60 may be detected, as described above, the controller 90 may drive the opening/closing motor 14 to allow the lower drawer 30 to be closed [S380: Lower drawer closing step]. As such, when the upper drawer 60 opens when the lower drawer 30 opens, the lower drawer 30 may be rapidly closed, thereby preventing the two doors 60 and 30 from being opened at the same time.

Figure 30:
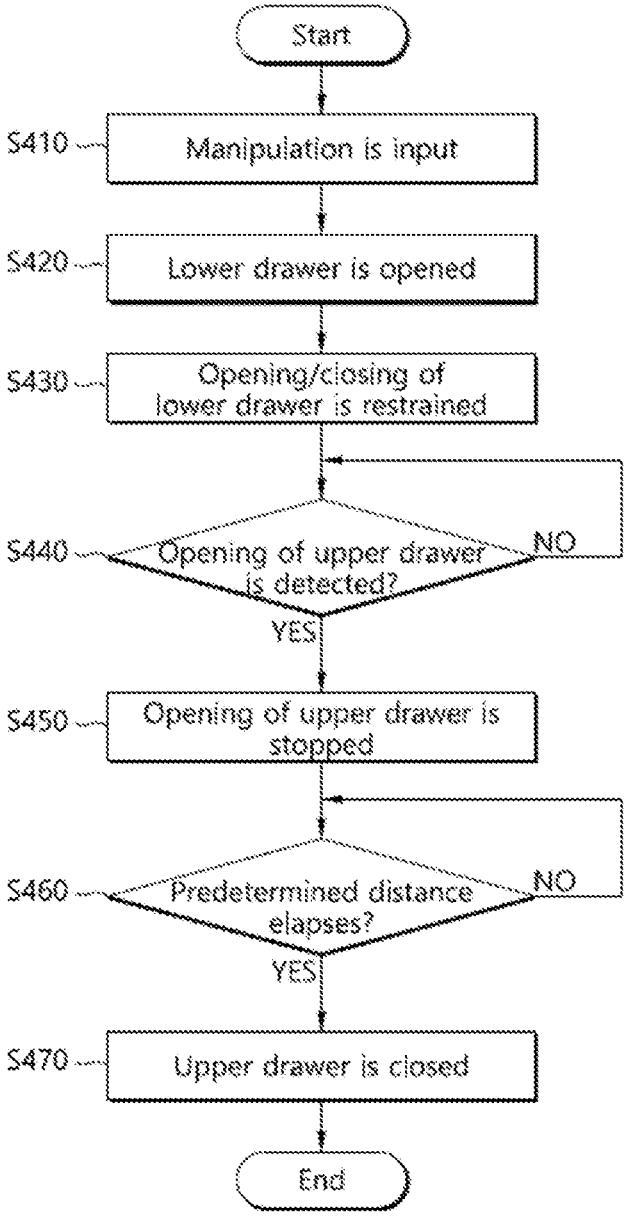

FIG. 30 shows a flowchart illustrating another operation of the upper drawer when the upper drawer may be opened when the lower drawer may be opened. Referring to FIGS. 26 and 30, for the opening/closing of the lower drawer 30, a user may input opening/closing manipulation through the manipulation units 22, 301, and 302. When no manipulation may be input from any one of the manipulation units 214, 301, and 302, the lower drawer 30 may be not opened [S410: manipulation input step].

The controller 90 causes the lower drawer 30 to be operated when a manipulation input may be input in the manipulation input step. When the opening/closing motor 14 is operated according to the instruction of the controller 90, the lower drawer 30 may be opened forward. The opening/closing distance of the lower drawer 30 may be determined by the open/close detecting part 15 of the lower drawer 30.

When the open/close detecting part 15 detects that the lower drawer 30 may be completely opened, the controller 90 may determine that the opening of the lower drawer 30 may be completed. When it may be determined that the opening of the lower drawer 30 may be completed, the driving of the opening/closing motor 14 may be stopped [S420: Lower drawer opening step].

Herein, when the opening of the lower drawer 30 is completed, the opening/closing motor 14 may be braked so as not to be rotated any more. For example, while the lower drawer 30 may be opened, the lower drawer 30 may maintain the opened state so that the user may work stably. To this end, the opening/closing motor 14 may be embodied by a braking motor provided with a brake capable of optionally restraining the motor [S430: Lower drawer opening/closing restraint step].

As such, the upper drawer 60 may be opened in a state where the lower drawer 30 may be completely drawn out and opened. For example, in a state where the lower drawer 30 may be opened, a user may open the upper drawer 60 to pick up the food from the upper drawer 60. When the upper drawer 60 is opened when the lower drawer 30 is opened, the opening of the upper drawer 30 may be detected by the open/close detecting part 15 of the upper drawer 60 [S440: upper drawer opening detection step].

When the opening of the upper drawer 60 is detected as described above, a timer 91 counts the elapsed time from a time point of detection, and the opening/closing motor 14 is operated to stop the upper drawer 60 for the predetermined time from the time point of the detection. Therefore, when the upper drawer 60 is opened when the lower drawer 30 is opened, the opening of the upper drawer 60 may be stopped for the predetermined time so that the upper drawer 60 may opened no longer [S450: Upper drawer opening stop step]. Thereafter, the controller 90 may determine whether the predetermined time may have elapsed from the time point when the opening of the upper drawer 60 is detected using the time counted by the timer 91. The predetermined time may be in the range of 0.5 to 2 seconds [S460: Time lapse determination Step].

When the predetermined time has elapsed, the controller 90 drives the opening/closing motor 14 to cause the upper drawer 60 to be closed [S470: Upper drawer closing step]. As described above, when the upper drawer 60 is opened while the lower drawer 30 may be opened, the upper drawer 60 may be rapidly closed, thereby preventing the two doors 60 and 30 from being opened at the same time.

Aspects of the present disclosure provide a refrigerator and a control method for the refrigerator, in which a part of the inside of the drawer opened in a drawer manner may be raised, thereby improving the inconvenience of use. In addition, another aspect of the present disclosure provides a refrigerator and a control method for the refrigerator, which forcibly restrains the opening of the upper drawer in a state where the lower drawer is raised, thereby securing the use safety and preventing the damage of the door. In addition, another aspect of the present disclosure provides refrigerator and a control method of the refrigerator, in which when one door starts to operate for lifting, the other door positioned above may be immediately restrained. In addition, another aspect of the present disclosure provides a refrigerator and a control method for the refrigerator, which prevents the plurality of drawers from being opened at the same time and thus the refrigerator from falling forward when the plurality of drawers are disposed above and below.

In addition, another aspect of the present disclosure provides a refrigerator, in which when the plurality of drawers may be positioned above and below, when one door may be opened, other door may be restrained and prevented from being opened. In addition, another aspect of the present disclosure provides a refrigerator and a control method for the refrigerator, in which in the case that a plurality of drawers may be positioned above and below, when the lower drawer may be opened when the upper drawer may be opened, the lower drawer may be immediately closed and then restrained.

In addition, another aspect of the present disclosure provides a refrigerator and a control method of the refrigerator, in which in the case that a plurality of drawers may be positioned above and below, when the upper drawer-type door may be opened in a state where the lower drawer may be opened, the upper drawer may be opened by a predetermined distance and then restrained. In addition, another aspect of the present disclosure provides a refrigerator and a control method for the refrigerator, in which in the case that a plurality of drawers may be positioned above and below, when the upper drawer may be opened in a state where the lower drawer-type door may be opened, the upper drawer may be immediately closed and then restrained.

According to the present disclosure, in the case that two or more drawers may be provided in the lower space of the refrigerator, when the upper drawer may be opened by a predetermined distance in a state where the lower drawer may be opened, the upper drawer may be restrained so as not to be opened any more. Therefore, the present disclosure does not allow the upper drawer to be opened more than the predetermined distance when the lower drawer may be opened.

Herein, the predetermined distance may be shorter than the distance between the front portion of the upper drawer and the rear surface of the lifting member of the lower drawer. As a result, when the upper drawer may be opened by the predetermined distance, the upper drawer may be prevented from colliding with the rear surface of the lifting member of the lower drawer. According to the present disclosure, when the lower drawer may be opened in a state where the upper drawer may be opened, the lower drawer may be closed immediately when the opening of the lower drawer may be detected.

Herein, when the upper drawer may be completely opened, the opening/closing of the upper drawer may be restrained, and when the lower drawer may be completely closed, the opening/closing of the lower drawer may be restrained. The present disclosure may be configured so that the opening of the upper drawer may be stopped when the opening of the upper drawer may be detected in a state where the lower drawer may be opened, and then the upper drawer may be closed after the predetermined time may have elapsed.

According to the present disclosure, when the opening of the upper drawer may be detected in a state where the lower drawer may be opened, the upper drawer may be restrained at the predetermined distance, and then a restraint signal may be generated to notify the user that the upper drawer may be opened according to the restraint signal. Accordingly, the user may recognize that the upper drawer may be opened while the lower drawer may be opened, and take an action.

According to the present disclosure, when the restraint signal may be generated, any one of the upper drawer and the lower drawer may be closed first. The present disclosure may be provided to allow the upper drawer to be closed immediately or after a predetermined time may have elapsed when the opening of the upper drawer may be detected in the case that the lifting member in the lower drawer may be being raised or may be at the maximum raising position. Herein, the opening of the upper drawer may be restrained at the predetermined distance so as not to be opened any more.

According to the present disclosure, in the case that the lifting member in the lower drawer may be being lowered or at the maximum lowering position, the upper drawer may be closed immediately or after the predetermined time may have elapsed when the opening of the upper drawer may be detected.

The refrigerator according to an embodiment of the present disclosure may be configured such that a part of the storage space inside the drawer may be raised in a state that the drawer may be opened. Therefore, the user does not have to bend forward excessively when storing food inside the drawer positioned below, thereby improving convenience of use. For example, the user may have to pick up the food or container with a great deal of force in order to take out a heavy food or a container containing the food in the related art. According to the present disclosure, there may be an advantage that the lifting member inside the drawer may be raised to a position convenient for use by the driving of the lift assembly, thereby preventing the injury of the user and significantly improving the convenience of use.

In addition, a lifting member on which the food or container may be seated may be positioned inside the drawer, and lift assemblies may be configured to be provided at both sides of the drawer for lifting of the lifting member, to make it possible to allow the lifting member to be raised while being supported at both sides. Therefore, the lifting member can be prevented from tilting or being off-center, and thus there may be an advantage of ensuring stable lifting motion and reliability of motion.

When the lower drawer positioned below may be opened, the upper drawer arranged above may be restrained by the upper drawer restraint part so as not to be opened. Thus, even when the lower drawer may be opened for lifting and then raised, the upper drawer maintains the closed state and may be restrained not to be opened, thereby preventing safety accidents and breakage of the drawer. The lower drawer and the food stored inside the lower drawer may be prevented from colliding with the upper drawer and being damaged.

In addition, the upper drawer restraint part may be configured to restrain the upper drawer simultaneously with opening of the lower drawer, so that it may be possible to restrain the opening of the upper drawer only by the opening manipulation of the lower drawer without a separate manipulation and it may be possible to open the upper drawer only by the closing manipulation of the lower drawer, thereby improving convenience of use and ensuring operational reliability.

In addition, a lower drawer restraint device may be provided to allow the lower drawer to be restrained by the opening manipulation of the lower drawer in a state where the upper drawer may be opened. Therefore, since the upper drawer and the lower drawer may be prevented from being opened at the same time, there may be an advantage that can prevent the refrigerator from falling forward due to movement of the center of gravity.

The upper drawer restraint part and the lower drawer restraint part may be provided in a partition member between the upper drawer and the lower drawer, and accordingly, there may be an advantage of enabling selective restraint of the upper drawer and the lower drawer without losing a volume of the inside of the refrigerator.

In addition, the upper drawer restraint part and the lower drawer restraining device have a structure that may be operated by power occurring when any one of the upper drawer and the lower drawer may be closed and opened to move the other door to be restrained, when the upper drawer and lower drawer may be opened and closed, whereby there may be an advantage that the configuration may be simple and the operational reliability may be high.

In addition, the upper drawer restraint part and the lower drawer restraint device may have a structure capable of restraining the lower drawer and the upper drawer mechanically in association with the opening/closing of the upper drawer and the lower drawer, respectively. Accordingly, there may be an advantage that the operation delay by the electronic device may be prevented to ensure immediate operation, whereby a reliable operation may be possible without malfunction. In addition, since power supply and signal transmission may be unnecessary, there may be an advantage in that assembly and serviceability can be improved.

In addition, in the case that there may be drawers positioned above and below, when the lower drawer positioned below may be opened in a state where the upper drawer positioned above may be opened, the lower drawer may be immediately closed. Therefore, it may be possible to prevent the two drawers from being opened at the same time to eliminate the risk of falling forward.

In addition, in the case where the upper drawer positioned above may be opened in a state where the lower drawer positioned below may be opened, the upper drawer may be opened by a predetermined distance and then immediately restrained so as not to be opened, and the lower drawer may be closed. Therefore, it may be possible to prevent the two drawers from being opened at the same time to eliminate the risk of falling forward.

An embodiment may be achieved in a whole or in parts by a control method for a refrigerator, the method comprising: inputting a user's manipulation input; opening an upper drawer by operating an opening/closing motor of the upper drawer according to the user's manipulation input; determining whether opening of a lower drawer is detected by an open/close detecting part of the lower drawer in a state where the upper drawer is opened; and closing the lower drawer by operating an opening/closing motor of the lower drawer when it is determined that the opening of the lower drawer is detected. The opening of the upper drawer may include restraining opening/closing of the upper drawer when the upper drawer is completely opened. The method may further comprise, after the closing of the lower drawer, restraining opening/closing of the lower drawer when the lower drawer is completely closed.

An embodiment may be achieved in a whole or in parts by a control method for a refrigerator, the method comprising: inputting a user's manipulation input; opening a lower drawer by operating an opening/closing motor of the lower drawer according to the user's manipulation input; opening an upper drawer in a state where the lower drawer is opened; and when the upper drawer is opened by a predetermined distance, restraining the opening of the upper drawer by an upper drawer restraint part at the predetermined distance.

When the upper drawer is restrained at the predetermined distance by the upper drawer restraint part, the upper drawer is no longer permitted to be opened but is permitted to be closed. The predetermined distance is shorter than a distance between a rear surface of a lifting member of the lower drawer and a front surface of the upper drawer. The method may further comprise, after the opening of the lower drawer, raising a lifting member of the lower drawer. The restraining of the upper drawer may include generating a restraint signal and notifying the outside that the upper drawer is opened according to the generated restraint signal, when the upper drawer is restrained at the predetermined distance. The method may further comprise after the restraining of the upper drawer, closing the lower drawer by operating the opening/closing motor of the lower drawer. The method may further comprise after the restraining of the upper drawer, closing the upper drawer by operating an opening/closing motor of the upper drawer. The closing of the upper drawer may include closing the upper drawer when a predetermined time elapses after the upper drawer is restrained.

An embodiment may be achieved in a whole or in parts by a control method for a refrigerator, the method comprising: inputting a user's manipulation input; opening a lower drawer by operating an opening/closing motor of the lower drawer according to the user's manipulation input; raising a lifting member by operating a lift motor of the lower drawer after stopping an operation of the opening/closing motor of the lower drawer, when an open/close detecting part of the lower drawer detects that the lower drawer is completely opened; and stopping the operation of the lift motor of the lower drawer when the lifting member is raised to a maximum raising position by a height sensor, wherein when opening of the upper drawer is detected by the open/close detecting part of the upper drawer in a state that the lifting member is raising or is at the maximum raising position, the upper drawer is closed by operating an opening/closing motor of the upper drawer.

The opening of the upper drawer is restrained at a predetermined distance and is no longer permitted to be opened. The method may further comprise, after the stopping of the lifting member, lowering the lifting member by operating the lift motor of the lower drawer when a lowering signal of the lifting member is input; and closing the lower drawer when the lifting member is lowered to a maximum lowering position, wherein when the opening of the upper drawer is detected by the open/close detecting part of the upper drawer in a state where the lifting member is lowering or is at the maximum lowering position, the upper drawer is closed by operating the opening/closing motor of the upper drawer.

An embodiment may be achieved in a whole or in parts by a refrigerator, comprising: a cabinet in which a storage space is formed; an upper drawer opening/closing a part of the storage space; a lower drawer provided below the upper drawer and opening/closing another part of the storage space; and an upper drawer restraint part provided in the storage space and selectively restraining the upper drawer according to whether the lower drawer is opened or closed, wherein the upper drawer restraint part restrains the opening of the upper drawer when the upper drawer is opened in a state where the lower drawer is opened.

When the upper drawer is opened by a predetermined distance, the upper drawer restraint part restrains the opening of the upper drawer at the predetermined distance. When the upper drawer is restrained at the predetermined distance, the upper drawer is closed. When the upper drawer is restrained at the predetermined distance, the lower drawer is closed. The predetermined distance is shorter than the distance between a rear surface of the lifting member of the lower drawer and a front surface of the upper drawer.

An embodiment may be achieved in a whole or in parts by a refrigerator, comprising: a cabinet in which a storage space is formed; an upper drawer opening/closing a part of the storage space; a lower drawer provided below the upper drawer and opening/closing another part of the storage space; an opening/closing motor providing power for the opening/closing of the lower drawer; an open/close detecting part detecting the opening/closing of the lower drawer; and a controller electrically connected to the opening/closing motor and the open/close detecting part, wherein the controller is configured so that the lower drawer is closed by operating the opening/closing motor when the opening of the lower drawer is detected by the open/close detecting part in a state where the upper drawer is opened.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

This application is also related to U.S. application Ser. No. 16/583,726 filed Sep. 26, 2019, U.S. application Ser. No. 16/582,647 filed Sep. 25, 2019, U.S. application Ser. No. 16/582,518 filed Sep. 25, 2019, U.S. application Ser. No. 16/582,605 filed Sep. 25, 2019, U.S. application Ser. No. 16/582,712 filed Sep. 25, 2019, U.S. application Ser. No. 16/582,756 filed Sep. 25, 2019, U.S. application Ser. No. 16/582,810 filed Sep. 25, 2019, U.S. application Ser. No. 16/582,668 filed Sep. 25, 2019, U.S. application Ser. No. 16/582,755 filed Sep. 25, 2019, U.S. application Ser. No. 16/582,831 filed Sep. 25, 2019, U.S. application Ser. No. 16/585,284 filed Sep. 27, 2019, and U.S. application Ser. No. 16/585,301 filed Sep. 27, 2019, whose entire disclosures are also hereby incorporated by reference.

What is claimed is:

1. A method for controlling a refrigerator, the method comprising:

applying, by one or more motors of the refrigerator, force to open a second drawer of the refrigerator;

applying, by the one or more motors of the refrigerator, force to open a first drawer of the refrigerator when the second drawer is opened, the second drawer being positioned lower than the first drawer; and after the first drawer moves to be opened by a particular distance while the second drawer is open, restraining the first drawer from opening further than the particular distance.

2. The method of claim 1, wherein restraining the first drawer from further opening includes engaging the first drawer such that the first draw is allowed to move in a closing direction but not allowed to move in an opening direction beyond the particular distance.

3. The method of claim 1, wherein the particular distance is less than a distance between a rear surface of a lifting mechanism received in the second drawer and a front surface of the first drawer.

4. The method of claim 1, further comprising:

after the second drawer is opened, controlling a lifting mechanism received in the second drawer to extend such that a portion of the lifting mechanism is raised from a first position to a second position that is above the first position by a lift assembly and is guided by a rail assembly disposed at both side of the lifting mechanism.

5. The method of claim 1, further comprising:

outputting, after restraining the first drawer from further opening beyond the particular distance, an indication that the first drawer is being restrained from opening beyond the particular distance.

6. The method of claim 1, further comprising:

after the restraining the first drawer from further opening beyond the particular distance, applying force to close the second drawer.

7. A refrigerator, comprising:

a cabinet in which a storage space is formed;

a first drawer that moves to open and close a first opening of the storage space;

a second drawer that is provided below the first drawer and moves to open and close a second opening of the storage space; and a first drawer restraint latch provided in the storage space, the first drawer restraint latch selectively restraining the first drawer based on whether the second drawer is opened or closed, wherein the first drawer restraint latch engages the first drawer to prevent the first drawer from further opening when the second drawer is opened.

8. The refrigerator of claim 7, wherein when the first drawer is opened by a particular distance, the first drawer restraint latch engages the first drawer to prevent the first drawer from opening beyond the particular distance.

9. The refrigerator of claim 8, further comprising a motor that provides force to open and close the first drawer, the motor applying force to close the first drawer when the first drawer is engaged by the first drawer restraint latch to prevent the first drawer from opening beyond the particular distance.

10. The refrigerator of claim 8, further comprising a motor that provides force to open and close the second drawer, the motor applying force to close the second drawer when the first drawer restraint latch engages the first drawer to prevent the first drawer from opening beyond the particular distance.

11. The refrigerator of claim 8, wherein the particular distance is less than a distance between a rear surface of a lifting mechanism of the second drawer and a front surface of the first drawer.

* * * * *